US010189550B2

(12) United States Patent
Santa Catarina

(10) Patent No.: US 10,189,550 B2
(45) Date of Patent: Jan. 29, 2019

(54) COMPACT, PEDAL-PROPELLED BOATS

(71) Applicant: Mateus Frois Santa Catarina, Rio de Janeiro-RJ (BR)

(72) Inventor: Mateus Frois Santa Catarina, Rio de Janeiro-RJ (BR)

( * ) Notice: Subject to any disclaimer, the term of this patent is extended or adjusted under 35 U.S.C. 154(b) by 0 days.

(21) Appl. No.: 15/320,857

(22) PCT Filed: Feb. 24, 2015

(86) PCT No.: PCT/BR2015/050015
§ 371 (c)(1),
(2) Date: Dec. 21, 2016

(87) PCT Pub. No.: WO2016/134429
PCT Pub. Date: Sep. 1, 2016

(65) Prior Publication Data

US 2017/0349253 A1 Dec. 7, 2017

(51) Int. Cl.
*B63H 16/20* (2006.01)
*B63B 7/00* (2006.01)
(Continued)

(52) U.S. Cl.
CPC ..... *B63H 16/20* (2013.01); *B63B 1/10* (2013.01); *B63B 7/00* (2013.01); *B63B 7/02* (2013.01);
(Continued)

(58) Field of Classification Search
CPC ..... B63H 16/20; B63H 16/202; B63H 23/02
See application file for complete search history.

(56) References Cited

U.S. PATENT DOCUMENTS 5,088,944 A * 2/1992 Kats ..... B63B 35/795 440/26
5,413,066 A * 5/1995 Spencer, Jr. ..... B63B 7/082 114/354
(Continued)

FOREIGN PATENT DOCUMENTS

BR PI0704432 A2 * 6/2009
WO WO-2013168997 A1 * 11/2013 ..... B63H 16/20

*Primary Examiner* — Joshua T Kennedy

(57) ABSTRACT

The present invention relates to two configurations of structure for a compact, pedal-propelled boat, a recumbent configuration and a conventional configuration, and to two possible propulsion systems, one with rigid transmission system and other with flexible transmission system. Both configurations are used with hulls arranged in parallel, catamaran configuration, preferably inflatable, allowing the volume and size of the assembly to be reduced so as to fit in a car trunk, making it easier to transport and store. In the recumbent configuration, the boat driver is in a sitting position, with his back supported by the seat, and actuates the pedals located in the front part of the structure while maneuvers the boat by means of handlebars located on the sides of the structure. In the conventional configuration, the boat driver is in the same position as the rider of a conventional bicycle, and the seat, pedals and handlebar are arranged in the same positions as in a bicycle. The invention seeks to provide simple solutions and the greatest quantity possible of shared components between these configurations, such that a production plant can produce these configurations through as few production processes as possible and sharing as many production processes as possible.

6 Claims, 17 Drawing Sheets

(51) Int. Cl.
*B63H 23/02* (2006.01)
*B63B 1/10* (2006.01)
*B63B 7/02* (2006.01)

(52) U.S. Cl.
CPC ..... *B63H 23/02* (2013.01); *B63H 2016/202* (2013.01)

(56) References Cited

U.S. PATENT DOCUMENTS

| | | | | |
|---|---|---|---|---|
| 5,651,706 | A * | 7/1997 | Kasper | B63B 7/082 114/354 |
| 2013/0157529 | A1* | 6/2013 | Santa Catarina | B63B 1/12 440/21 |
| 2015/0094156 | A1* | 4/2015 | Cordell | B25G 1/04 464/51 |
| 2016/0059945 | A1* | 3/2016 | Arad | B63H 5/15 440/23 |
| 2016/0075420 | A1* | 3/2016 | Kiffmeyer | B63H 16/20 440/27 |

* cited by examiner

COMPACT, PEDAL-PROPELLED BOATS

CROSS-REFERENCE TO RELATED APPLICATIONS

The present application claims the benefits of PCT/BR2015/050015, filed on Feb. 24, 2015, which is entitled "BARCOS COMPACTOS MOVIDOS A PEDAL" translated here to "COMPACT, PEDAL-PROPELLED BOATS", and are incorporated herein by reference in their entireties.

FIELD OF THE INVENTION

The present invention relates to the field of small boats.

SUMMARY OF THE INVENTION

The present invention relates to two structure configurations for compact pedal-propelled boat, one recumbent and another conventional as well as two propulsion system possibilities, one rigid and the other flexible. Both configurations are used with hulls arranged in parallel, catamaran configuration, preferably inflatable, allowing the volume and size of the assembly to be reduced so as to fit in a car trunk, making it easier to transport and store.

In the recumbent configuration, the driver assumes a sitting position with his back against the seat, and actuates the pedals located in the front of the structure while maneuvers the boat through handlebars located on the sides. In the conventional configuration, the driver assumes a position similar to a conventional bicycle, whereby the elements—seat, pedals and handlebars—are located as would be arranged on a bicycle.

It was adopted simple solutions and the greatest possible amount of components shared between the two configurations, so that a production plant can produce such configurations, with minimal production processes, and with the maximum shared processes.

There are several inventions designed to be used as a kind of aquatic bicycle with collapsible characteristics. The U.S. Pat. No. 3,640,239A, U.S. Pat. No. 4,092,945A and CA2069605C refers to devices that can be adapted to a conventional bicycle. The U.S. Pat. No. 5,651,706A discloses a compact boat which uses a pair of floats on a catamaran configuration. The U.S. Pat. No. 4,511,338A describes a device to be adapted on boards. All patent documents mentioned above, which are representative of the present state of the art, possess one or more of the following disadvantages solved by the present invention: production difficulty; assembly difficulties; low efficiency; operating difficulties; difficulty of maintenance.

The present invention presents two ways of propulsion system, one rigid and the other flexible. Both systems shares the gearbox assembly, which accommodates the drive elements, thus allowing a gear to transfer the rotational movement of the pedals to a pinion disposed at 90 degrees. As it will be described, the gearbox assembly elements are mounted in a simple way, using only retaining rings, providing a clean and robust design.

In the rigid transmission system, an outer tube is fixed to the gearbox and accommodates the drive elements that allow the pinion rotational movement to be transferred to the propeller shaft, located at the end of the outer tube and arranged 120 degrees relative to the pinion shaft. As it will be described, this system enables the transmission elements to be pre-assembled before being introduced into the outer tube, which facilitates assembly and disassembly.

In the flexible transmission system, a flexible shaft is mounted inside a flexible tube, being connected to the pinion shaft and transmits the motion to the propeller shaft, which is positioned at the bottom of a support, which is embedded in the location where It would be installed the rudder. As the drive shaft is flexible, the propeller shaft may be directed to the left or right, allowing change the direction of the force generated by the propeller attached to it, allowing to maneuver the vessel, eliminating thus the use of the rudder.

BRIEF DESCRIPTION OF THE DRAWINGS

The preferred embodiments of the present invention will now be described, by way of non-limiting examples of the invention, with reference to the attached drawings. In the drawings.

DETAILED DESCRIPTION OF THE INVENTION

To display the preferred embodiments of the present invention, the elements that compose it will be shown following an order of manufacturing or assembly, which facilitates understanding.

Figure 1:
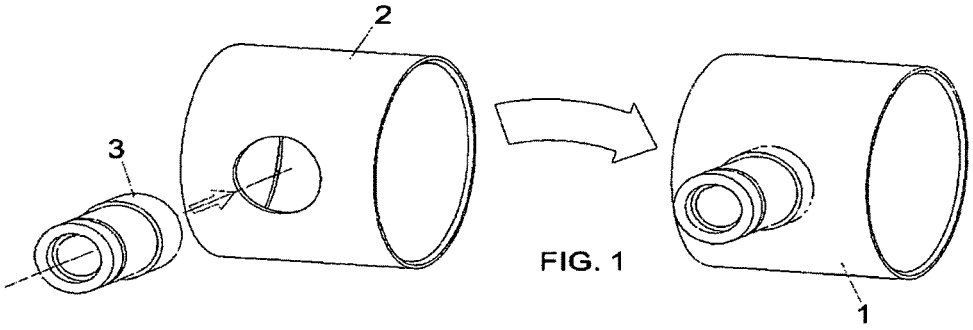
FIG. 1 is made up of figures that illustrate the manufacturing process of a gearbox for use in transmission systems according to the invention "compact, pedal-propelled boats"
Figure 2:
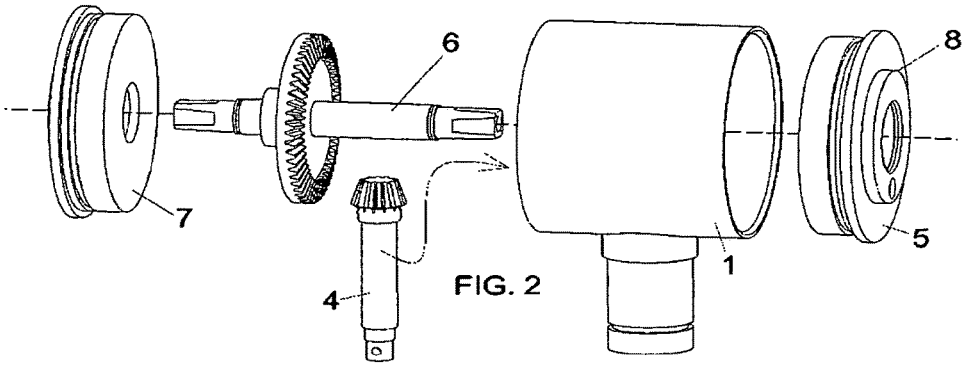
FIG. 2 is made up of figures that illustrate the main transmission elements in a gearbox for use in transmission systems according to the invention "compact, pedal-propelled boats"
Figure 3:
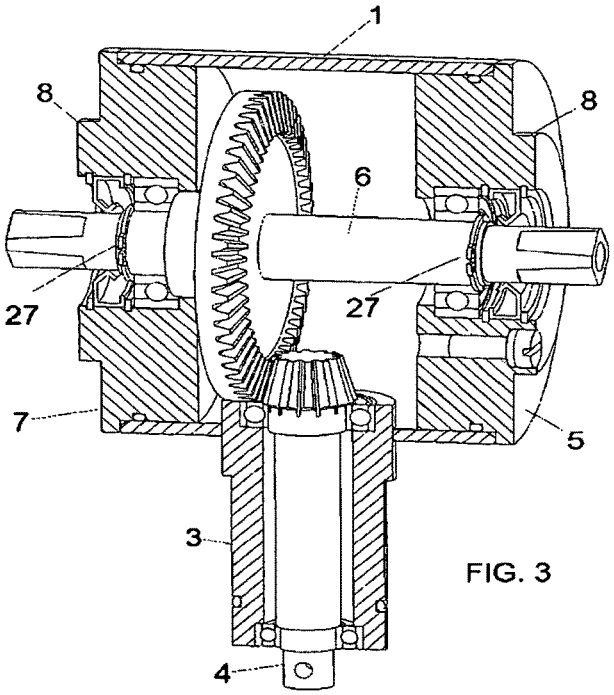
FIG. 3 is a perspective view, in section, of a gear box assembled for use in transmission systems according to the invention "compact, pedal-propelled boats"

FIG. 1 shows the gearbox 1, made from a tube 2 and a cylindrical housing 3 which are joined by welding. FIG. 2 shows the main elements that make up the transmission assembly. FIG. 3 shows the transmission gearbox assembled. The transmission elements are assembled in the following order: First the bearings are positioned in seats inside the cylindrical housing 3. Subsequently pinion shaft 4, which is a pinion integrated to a shaft, is inserted in the bearings located inside the cylindrical housing 3, from the interior of the gearbox 1. In sequence, the right bushing 5 is inserted on the right side of the gearbox 1. At this stage, the right bushing 5 should already be with your bearing housed and with your o-ring installed. Now the gear shaft 6, which is a gear integrated to a shaft, can be inserted from the left side of the gearbox 1, until the gear is engaged in the pinion. At this point the left bushing 7 is inserted into the left side of the gearbox 1. At this stage, the left bushing 7 should already be with your bearing housed and with your o-ring installed. Now two retaining rings 27 are installed on the gear shaft 6, one on the right and other on the left, preventing any relative axial movement between the gear shaft 6 and the gearbox 1. For example, a force F acting on the gear shaft 6 on the right side, will be transmitted to the retaining ring 27 installed on the right side, which in turn transmits it to the bearing in the right bushing 5, which in turn transmits it to the right bushing 5 which in turn transmits it to the right side of the gearbox 1 which generates a resistive force Rf, equal and opposite to the force F (friction forces were excluded to facilitate understanding). The same reasoning can be applied to the left side. Note that these two retaining rings 27 are responsible for keeping the elements positioned, without the need of any additional fixing element. The seals are then installed to maintain the interior of the gearbox 1 sealed. For this purpose, it is first installed a retaining ring in the right bushing 5 hole, which has the sole function, to serve as a stop for the retainer that is installed in sequence this retaining ring can be replaced by a spacer ring or by a recess in the right bushing 5 hole, in which case it would be necessary to use a seal with larger outer diameter than the outer diameter of the bearing. After inserting the seal, a second retaining ring is used in the bushing hole to prevent the seal from coming loose. At this time the gearbox is assembled. It is important to note that the right bushing 5 and left bushing 7 are identical, except for one hole in the right bushing 5, which lets you apply grease on the gears. This hole is sealed by a screw and o-ring. The right bushing 5 and left bushing 7 have a shoulder 8 on the outside, whose importance will be explained forward.

Figure 12:
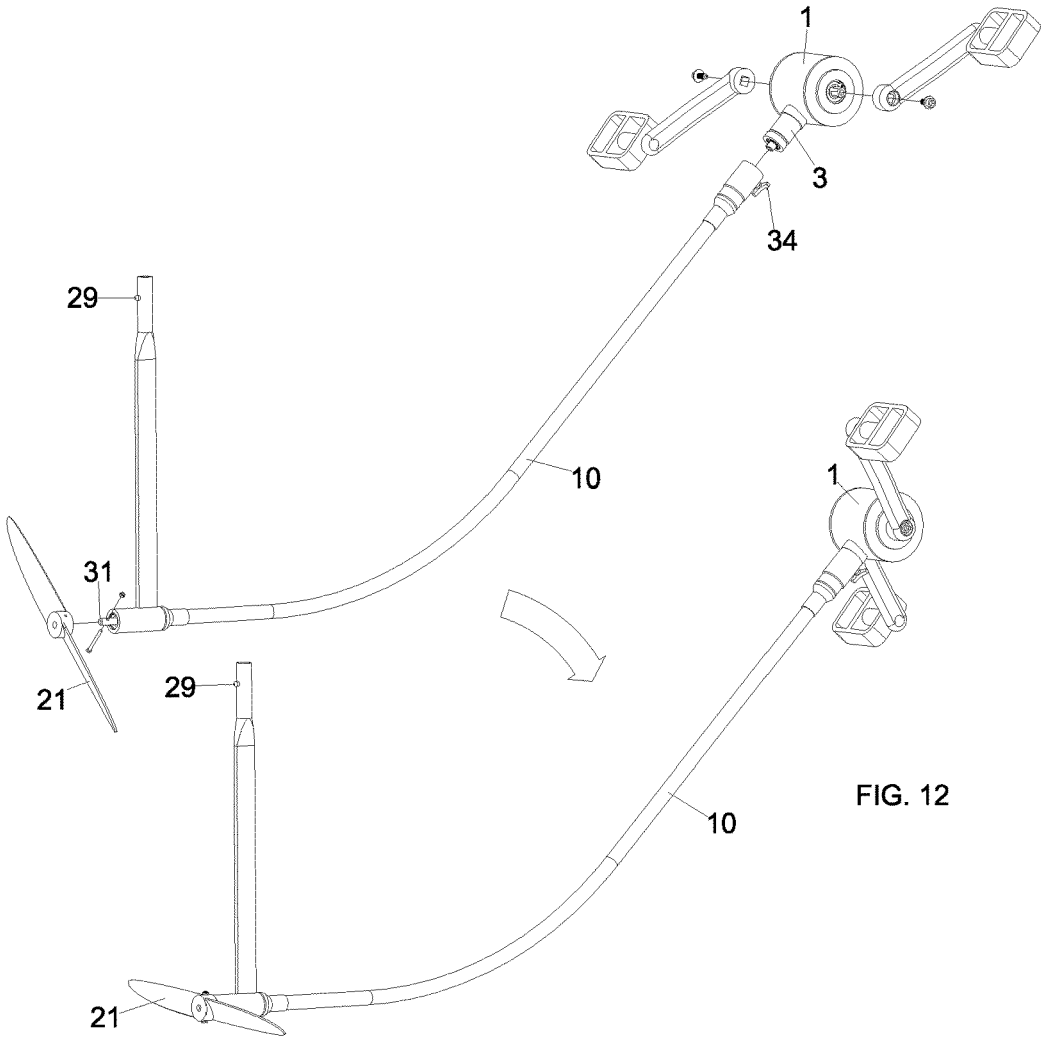
FIG. 12 is made up of figures that illustrate the process of installing a propeller and the coupling to the gearbox of a flexible transmission system according to the invention "compact, pedal-propelled boats", as well as the installation of cranks.

The gearbox 1, with all the transmission elements according to FIG. 3 can be used in different propulsive systems for pedal boats. This invention will comprise two types, a rigid transmission system 9 (FIG. 7) and a flexible transmission system 10 (FIG. 12).

Figure 4:
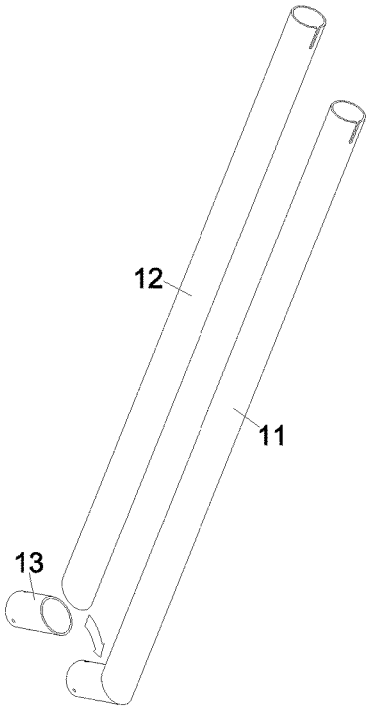
FIG. 4 is made up of figures that illustrate the manufacturing process of an outer tube of a rigid transmission system according to the invention "compact, pedal-propelled boats"
Figure 5:
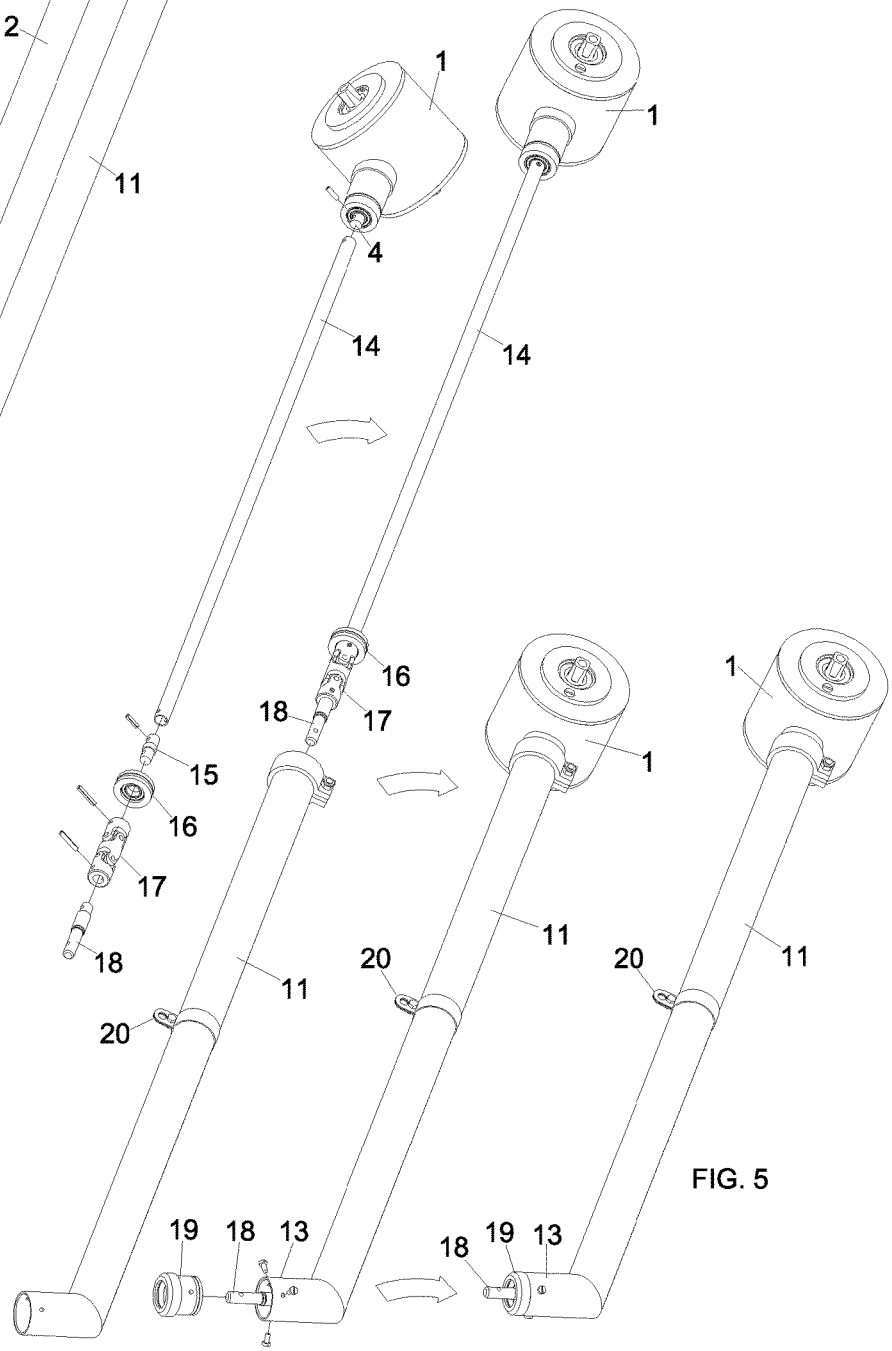
FIG. 5 is made up of figures that illustrate the assembly process of a rigid transmission system according to the invention "compact, pedal-propelled boats"
Figure 6:
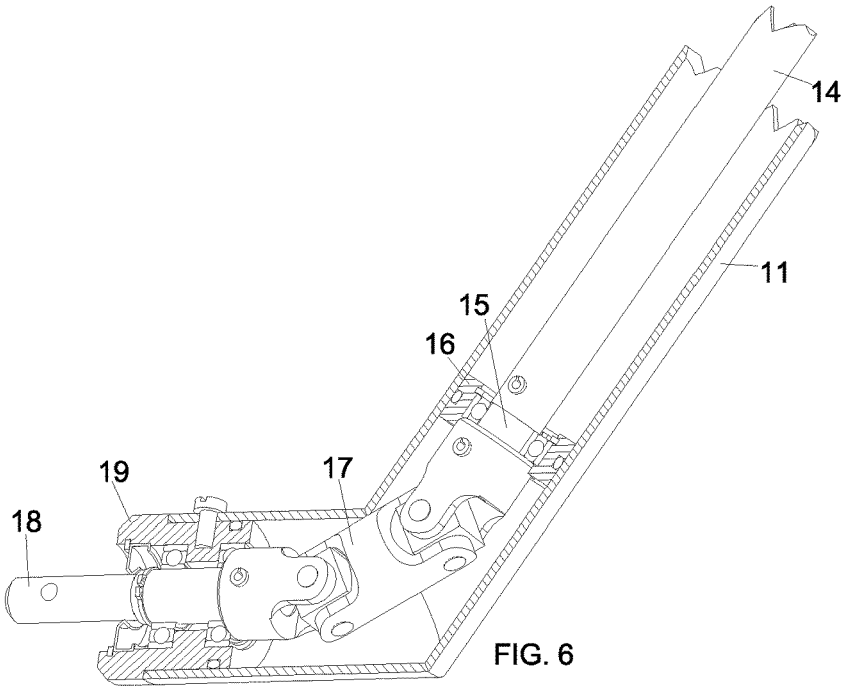
FIG. 6 is a perspective view, in section, showing the lower region of a rigid transmission system according to the invention "compact, pedal-propelled boats"
Figure 7:
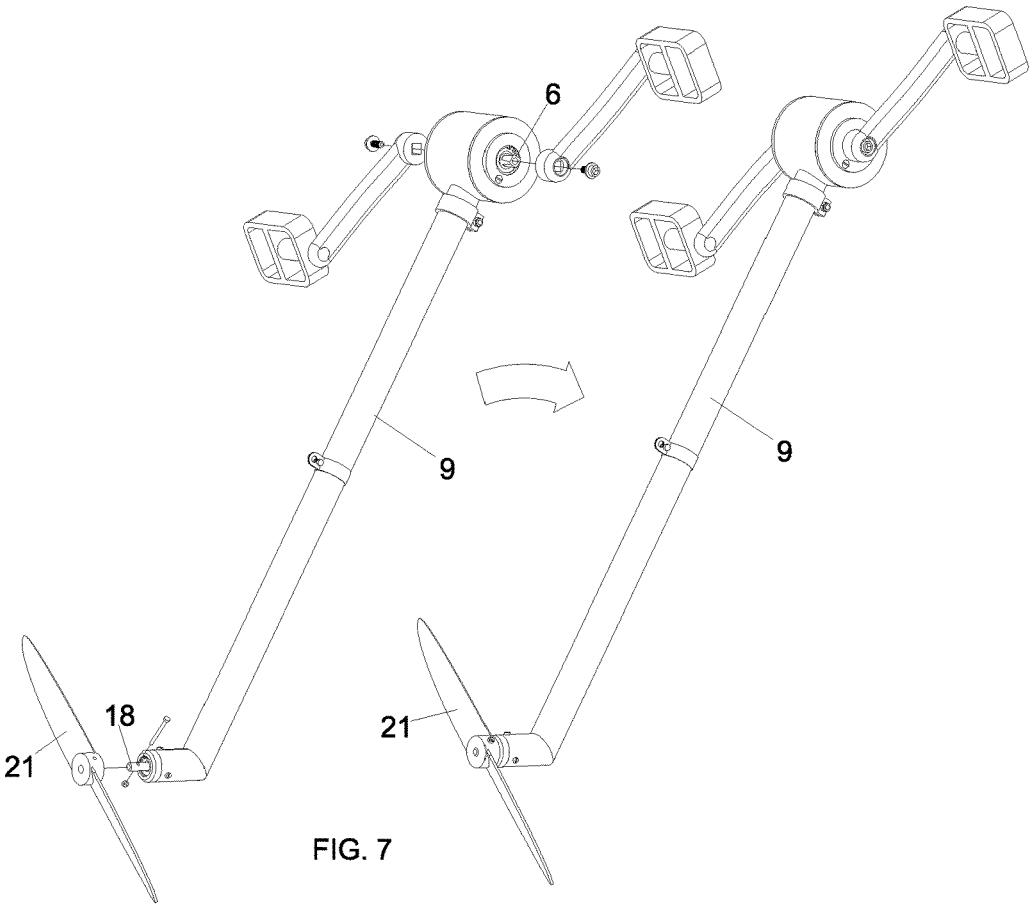
FIG. 7 is made up of figures that illustrate the installation process of cranks and a propeller on a rigid transmission system according to the invention "compact, pedal-propelled boats"

The rigid transmission system 9 has an outer tube 11 which is fixed to the gearbox 1. The outer tube 11 is made from two tubes, a long tube 12 and a short tube 13 which are welded together at an angle of about 120 degrees, as shown in FIG. 4. FIG. 5 illustrates the assembling of the rigid transmission system 9. First the torque tube 14 is fixed to the end of the pinion shaft 4 via a spring pin. At the other end of the torque tube 14 is fixed an intermediate shaft 15 via a spring pin. Then the intermediate shaft 15 is inserted in the bearing housed within the intermediate bushing 16 and is then attached to a double universal joint 17 by an elastic pin. Finally, the other end of the double universal joint 17 is fixed to the propeller shaft 18 via a spring pin. All these assembled components are then inserted into the outer tube 11 until the moment when the upper end of the outer tube 11 is engaged in the gearbox 1. The upper end of the outer tube 11 has a longitudinal slot enabling the grip through a clamp previously positioned outside the outer tube 11. At this point the propeller shaft 18 is positioned inside the short tube 13. The next step is to install the propeller bushing 19, which has two previously housed bearings and one o-ring installed on the outside. For this, the propeller bushing 19 is positioned at the end of the short tube 13 so that the propeller shaft 18 is inserted in the bearings housed in its interior, at the same time that its outer part is inserted into short tube 13. At the end of this operation, it must be installed a retaining ring to the propeller shaft 18, which together with the end of the double universal joint 17 restrict any axial movement of the propeller shaft 18 relative to the propeller bushing 19. Screws may be used to fix the propeller bushing 19 in the short tube 13. To prevent water from entering, a seal is installed at the end of propeller bushing 19 and then a retaining ring is applied to prevent the seal from coming loose. FIG. 6 shows how the components are arranged. The system is completely sealed, having a sealing o-ring installed to the outside of the cylindrical housing 3 as well as the outside of the propeller bushing 19. On the outside of the outer tube 11, a support 20 is installed whose importance will be explained forward. As shown in FIG. 7, a propeller 21 can be installed in the propeller shaft 18 through screw and nut and cranks can be installed at the ends of the gear shaft 6. When turning the pedals, the gear shaft 6 rotates driving the pinion shaft 4 which in turn transmits the movement through the torque tube 14 to the double universal joint 17, which in turn allows a homokinetic transmission of motion to the propeller shaft 18.

Figure 8:
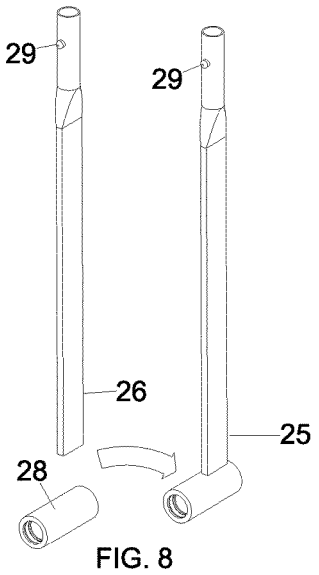
FIG. 8 is made up of figures that illustrate the manufacturing process of the propeller mount of a flexible transmission system according to the invention "compact, pedal-propelled boats"
Figure 9:
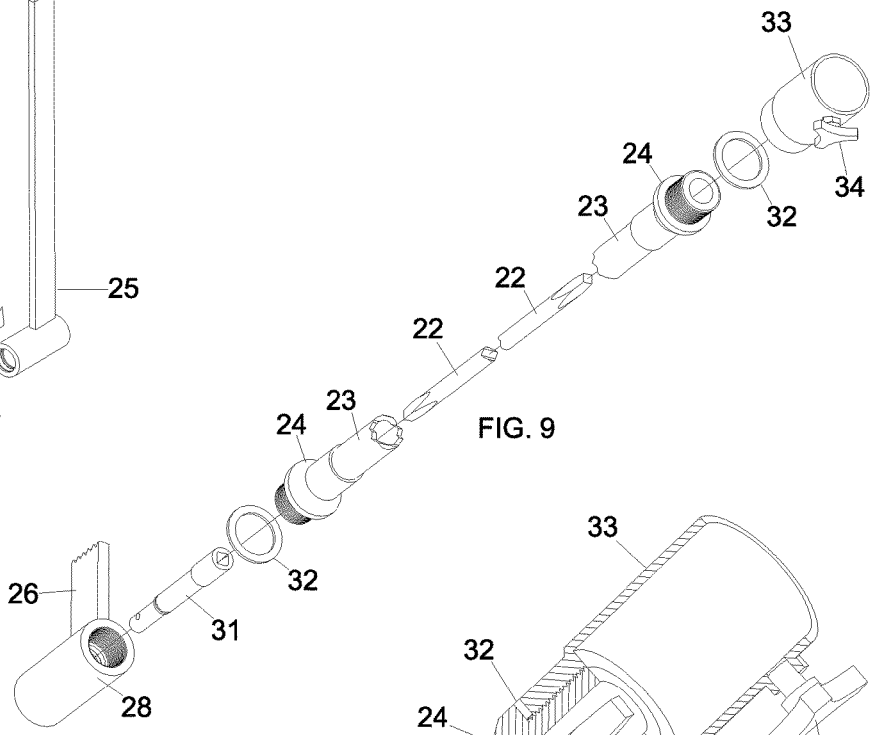
FIG. 9 is an exploded perspective view illustrating the assembling sequence of main elements that comprise a flexible transmission system according to the invention "compact, pedal-propelled boats"
Figure 10:
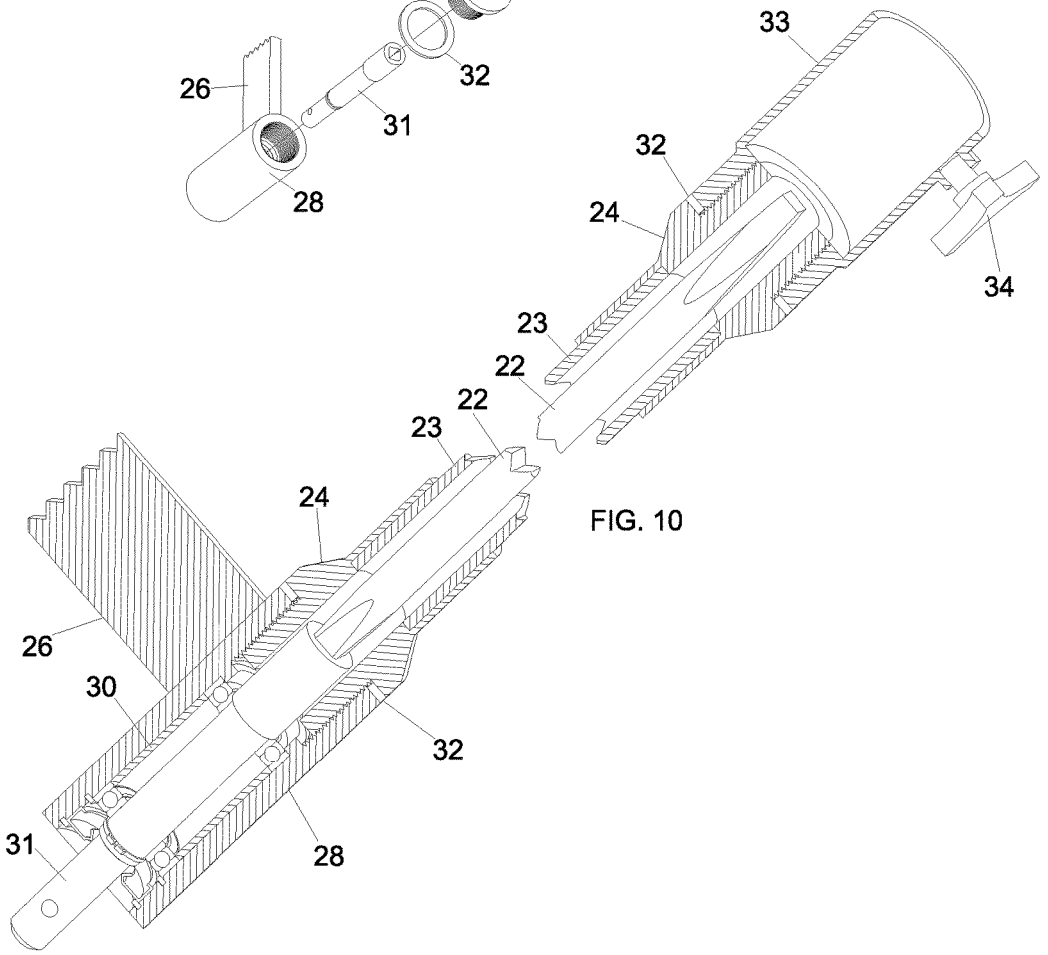
FIG. 10 is a perspective view, in section, of a flexible transmission system according to the invention "compact, pedal-propelled boats"
Figure 11:
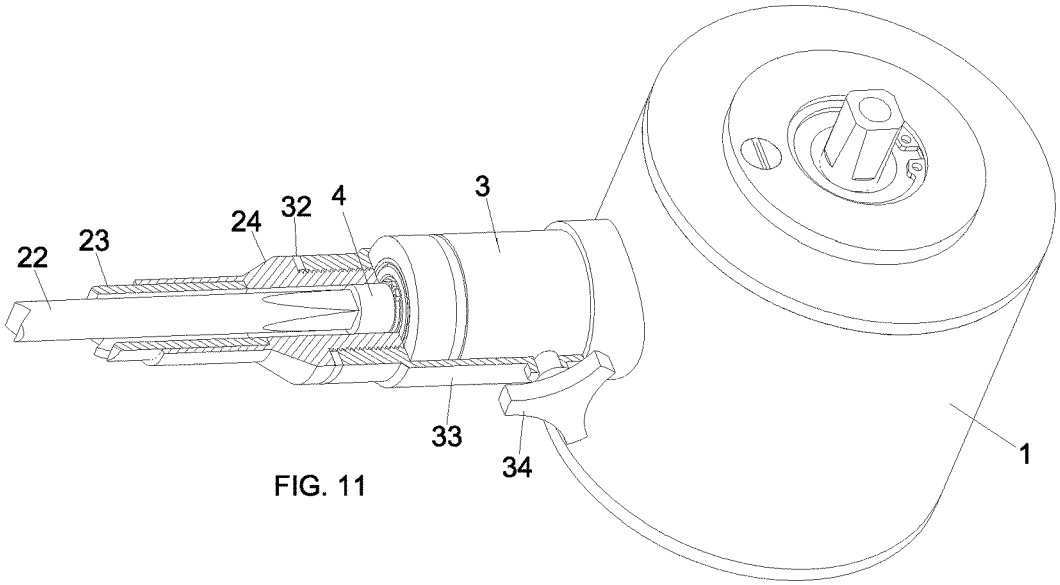
FIG. 11 is a perspective view of the coupling to the gearbox of a flexible transmission system according to the invention "compact, pedal-propelled boats"

The flexible transmission system 10 uses the propeller mount 25, which is attached to the rear of the boat structure. According to FIG. 8, the propeller mount 25 can be manufactured by joining by welding of the rod 26 and propeller bushing 28. The rod 26 is manufactured from a tube that is deformed mechanically on the side to reduce drag. In the upper region of the rod 26 there is a hole for placing a locking pin 29. FIG. 9 shows the order of assembly of the main components of the flexible transmission system 10. The flexible transmission system 10 utilizes a flexible shaft 22 for torque transmission. The flexible shaft 22 is mounted inside a flexible tube 23. The flexible tube 23 has threaded terminals 24 fixed at their extremities via the pressing process. The propeller bushing 28 has an internal thread at one end for fixing the threaded terminals 24 and seats for bearings and seals in its interior, as can be seen in FIG. 10. For assembling of the elements, primarily a bearing is inserted into the propeller bushing 28, followed by a spacer tube 30 and a second bearing. After placement of the second bearing a retaining ring is applied to the propeller bushing 28 hole to prevent axial displacement of the bearings. Then the propeller shaft 31 is introduced through the threaded end, until the moment in which the cam contacts the bearing. Then a retaining ring is applied to the propeller shaft 31, restricting its axial movement, which can be seen in FIG. 10. Finally, to prevent water from entering, a seal is applied, followed by a retaining ring that prevents the seal from loosening. The threaded terminals 24 can then be screwed onto the end of the propeller bushing 28, being necessary the use of a rubber seal 32 to prevent water ingress. The end of the propeller shaft 31 has a square section hole for fitting the end of the flexible shaft 22, whose section is also square, allowing transmission of rotational movement according to FIG. 10. The other end of flexible tube 23, which also has a threaded terminal 24, is fixed to a coupling 33 which has the function to fit the outside of the cylindrical housing 3, as shown in FIG. 11. The pinion shaft 4 in this case needs to have a square section hole for fitting the end of the flexible shaft 22 and having a retaining ring which limits its axial movement. This function of restricting the axial movement is performed by the torque tube 14 on the rigid transmission system 9, which eliminates the need for retaining ring. Thus, by engaging the coupling 33 to the cylindrical housing 3, the end of the flexible shaft 22 engages the pinion shaft 4 square hole allowing transmission of rotational motion. To keep the coupling 33 in their position, and to allow their rapid removal, it has a knob 34 with thread, as shown in FIG. 11. As shown in FIG. 12, a propeller 21 can be installed in the propeller shaft 31 by means of bolt and nut. Cranks can be installed at the ends of the gear shaft 6. When turning the pedals, the gear shaft 6 rotates driving the pinion shaft 4 which in turn transmits the movement through to the flexible shaft 22 which in turn transmits the movement to the propeller shaft 31.

Figure 13:
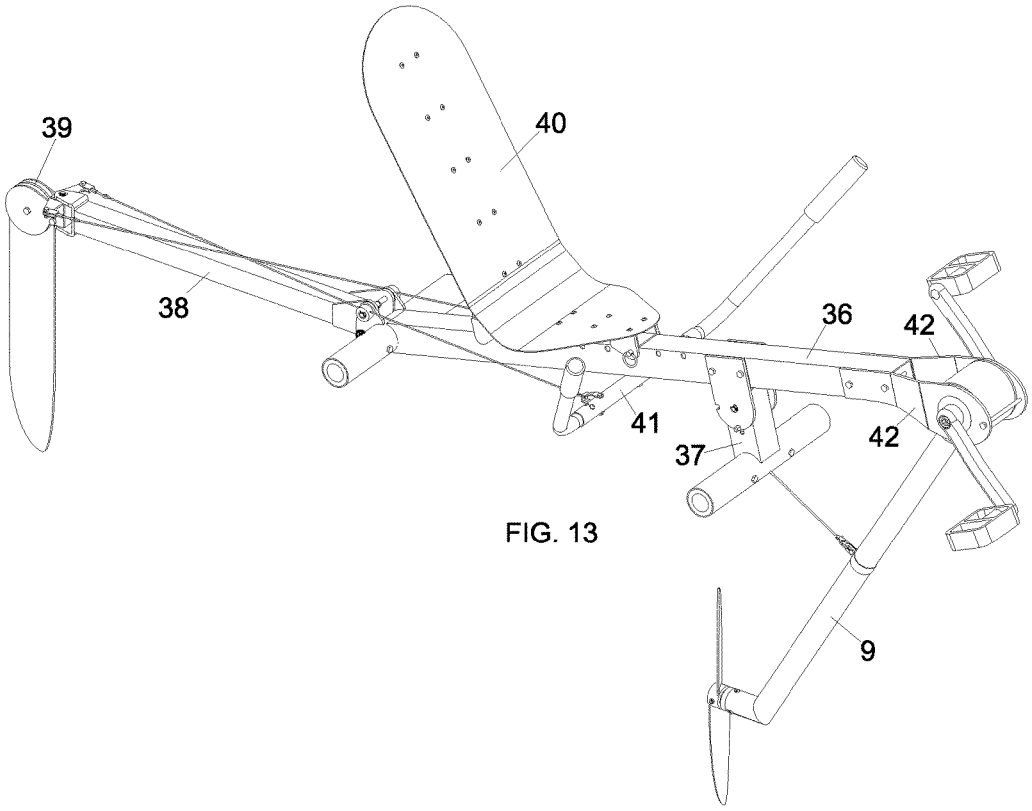
FIG. 13 is a perspective view of the structure of a compact boat with recumbent configuration according to the invention "compact, pedal-propelled boats", assembled with rigid transmission system.
Figure 14:
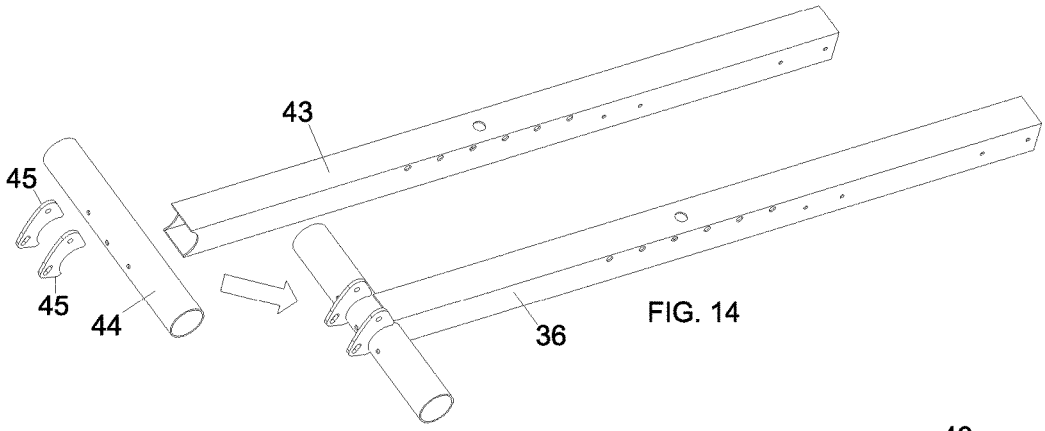
FIG. 14 is made up of figures that illustrate the manufacturing process of a main frame of a compact boat with recumbent configuration according to the invention "compact, pedal-propelled boats"
Figure 15:
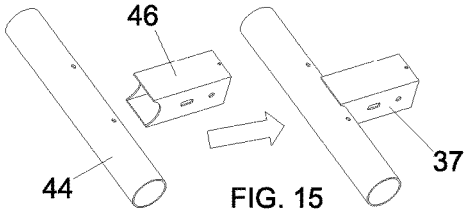
FIG. 15 is made up of figures that illustrate the manufacturing process of a T structure of a compact boat with recumbent configuration according to the invention "compact, pedal-propelled boats"
Figure 16:
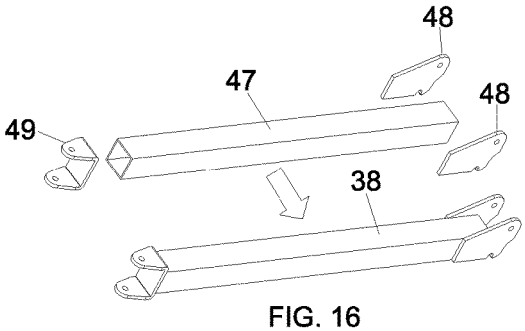
FIG. 16 is made up of figures that illustrate the manufacturing process of a pivotable rudder tube of a compact boat according to the invention "compact, pedal-propelled boats"
Figure 17:
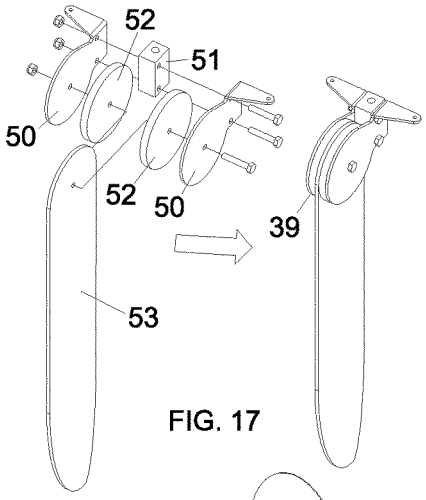
FIG. 17 is made up of figures that illustrate the process of assembling of a rudder assembly of a compact boat according to the invention "compact, pedal-propelled boats"
Figure 18:
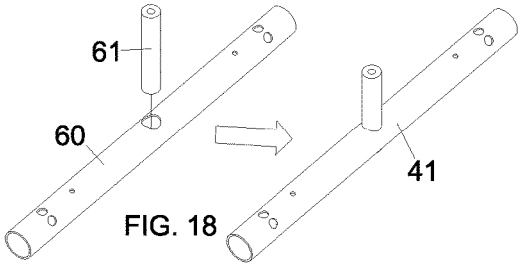
FIG. 18 is made up of figures that illustrate the manufacturing process of a handlebar support of a boat with a compact recumbent configuration according to the invention "compact, pedal-propelled boats"
Figure 19:
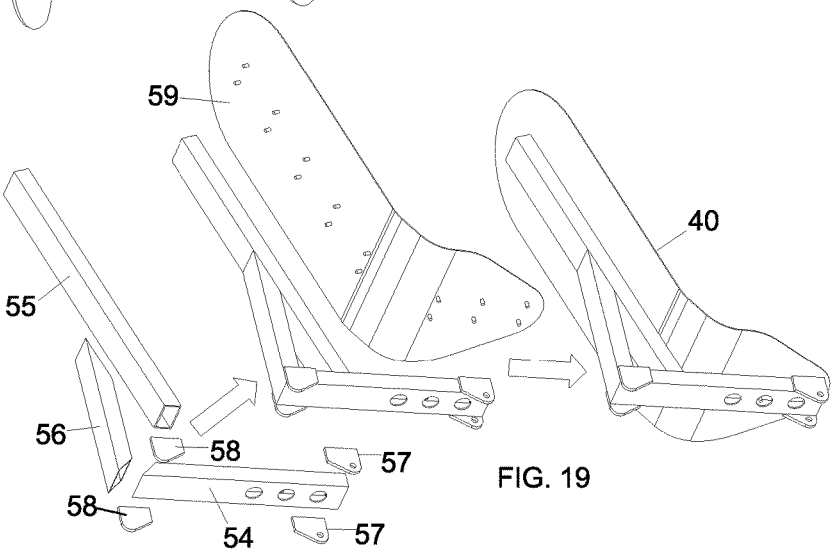
FIG. 19 is made up of figures that illustrate the manufacturing process of a seat for a boat with a compact recumbent configuration according to the invention "compact, pedal-propelled boats"
Figure 20:
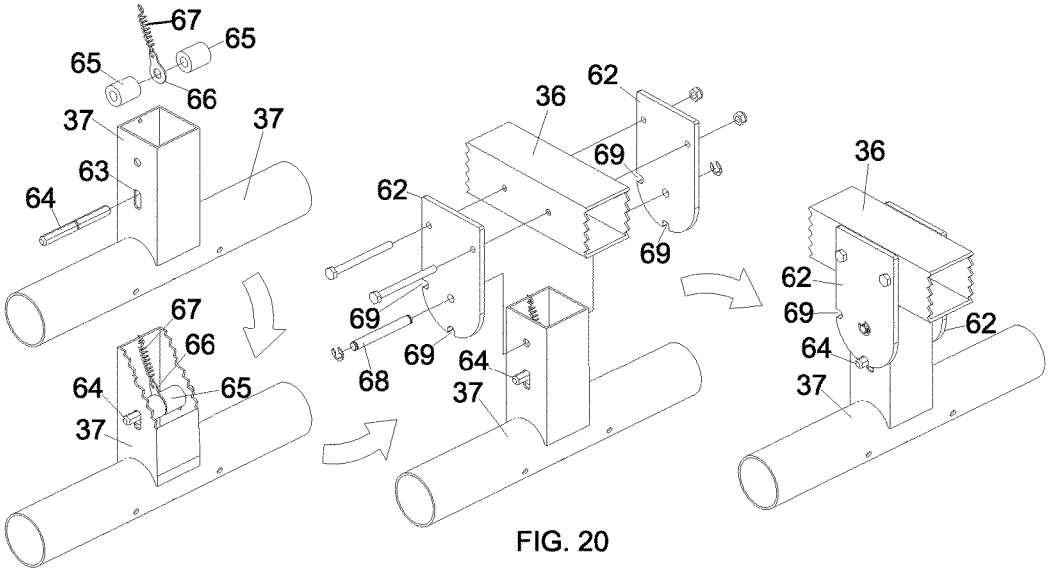
FIG. 20 is made up of figures that illustrate the assembly process of a T structure in the main frame of a compact boat according to the invention "compact, pedal-propelled boats"

FIG. 13 shows a structure for compact boat with recumbent configuration to be used with rigid transmission system 9. The main component parts of said structure are: main frame 36 T structure 37, pivotable rudder tube 38, rudder assembly 39, seat 40, handlebar support 41, and mounting plates 42. According to FIG. 14, the main structure 36 is made up with a long square tube 43, plug tube 44 and two outer hinge plates 45 which are joined by welding. According to FIG. 15, the T structure 37 is made up with a short square tube 46 and a plug tube 44, which are joined by welding. According to FIG. 16, the pivotable rudder tube 38 is made up with a square tube 47, two inner hinge plates 48 and the rudder mount 49, which are joined by welding. According to FIG. 17, the rudder assembly 39 is formed by two side supports 50, joint block 51, two spacer washers 52 and the rudder plate 53. The side supports 50 are attached to the joint block 51 via two bolts and nuts. Subsequently the two spacer washers 52, with the rudder plate 53 in the center, are positioned between the two side supports 50, so that overlap holes to allow entry of a screw which receives a nut on the other side, whose grip regulates the torque required to articulate the rudder plate 53. According to FIG. 18, the handlebar support 41 is formed by the support tube 60 and the handlebar axis 61, which are joined by welding. According to FIG. 19, the seat 40 is formed by the base tube 54, the backrest tube 55, brace tube 56, two fitting plates 57, two alignment plates 58 and the seat plate 59. All items are joined by welding. Alternatively, the seat plate 59 can be riveted. According to FIG. 20, the T structure 37 is assembled on the main frame 36 through the use of two hinge plates 62, which are previously fixed to the main frame 36 via two bolts and nuts. The T structure 37 has a longitudinal slot 63 in which is mounted a hexagonal lock 64. For assembling the hexagonal lock 64, two spacers cylinders 65 and a coupling plate 66 are positioned inside the T structure 37, so that the holes overlap, allowing the introduction of the hexagonal lock 64. Then the tension spring 67 is assembled, and one side fits through the hole in the coupling plate 66 and the other side in the hole on the end of the T structure 37. As the coupling plate 66 is positioned in the central position, it fits in the groove at the central position of the hexagonal lock 64, restricting its axial movement. Now the T structure 37 is positioned between the hinge plates 62, so that the holes overlap, allowing the introduction of the pivot pin 68 which is fixed with retaining rings in each of its extremities. The hinge plates 62 have two notch 69 for engaging the hexagonal lock 64 allowing the T structure 37 to be locked in two positions, operating position extended and the retracted position.

Figure 21:
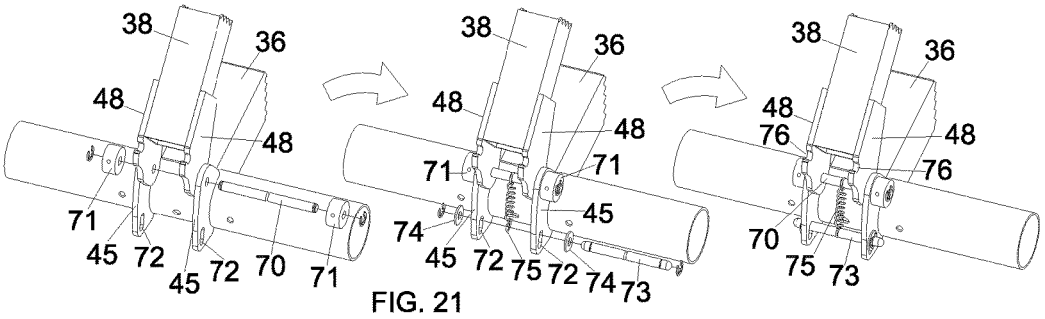
FIG. 21 is made up of figures that illustrate the assembly process of the pivotable rudder tube in a main frame of a compact boat according to the invention "compact, pedal-propelled boats"

To assemble the pivotable rudder tube 38 according to FIG. 21, it is positioned so that the holes present in the inner hinge plates 48 coincide with the holes present in the outer hinge plates 45, allowing introducing the pivot pin 70. After two cylinder guide 71 are inserted into each end of the pivot pin 70 which is fixed with retaining rings in each of the extremities. The outer hinge plates 45 have a slot 72 which is inserted a cylindrical latch 73. A washer 74 is placed in each of the extremities of the cylindrical latch 73 to facilitate sliding, followed by a retaining ring restricting the axial movement of the cylindrical latch 73. A tension spring 75 is assembled, and one side fits in the groove in the central part of the pivot pin 70 and the other in the groove present in the central part of the cylindrical latch 73. The inner hinge plates 48 have a notch 76 for engaging the cylindrical latch 73 according enlarged detail of FIG. 22, allowing the pivotable rudder tube 38 being locked in the operating position extended.

Figure 22:
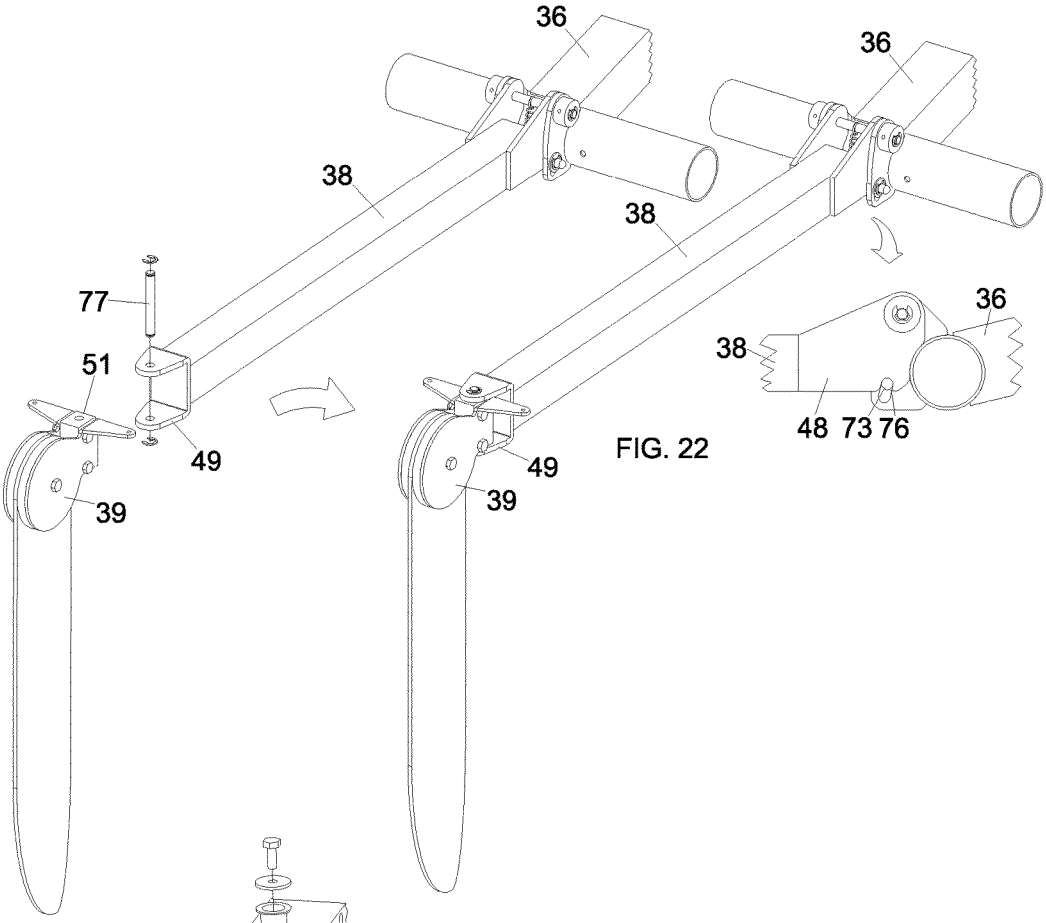
FIG. 22 is made up of figures that illustrate the assembling process of the rudder assembly on the pivotable rudder tube of a compact boat according to the invention "compact, pedal-propelled boats"

For mounting the rudder assembly 39 according to FIG. 22, it is positioned so that this hole in the joint block 51 coincide with the holes present on the rudder mount 49, allowing the introduction of the pivot pin 77 which is fixed with retaining rings in each one of the ends.

Figure 23:
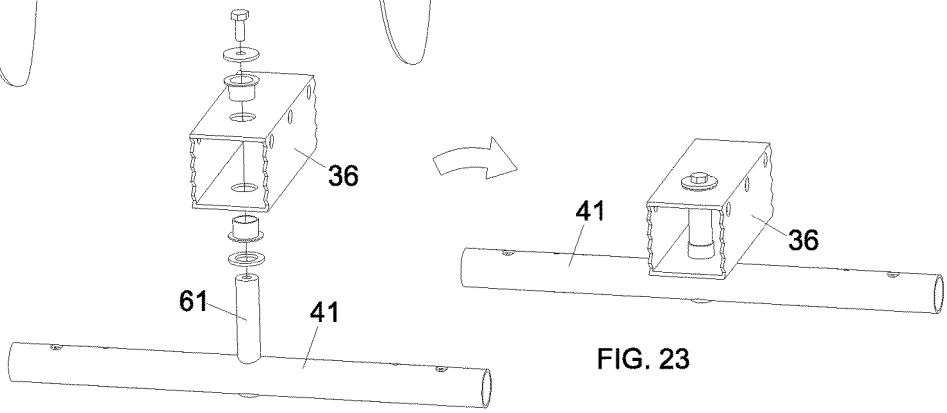
FIG. 23 is made up of figures that illustrate the assembly process of the handlebar support on a main frame of a compact boat with recumbent configuration according to the invention "compact, pedal-propelled boats"

For mounting the handlebar support 41, as shown in FIG. 23, first two bushings are inserted into the main frame 36. Subsequently the handlebar axis 61 is introduced into the bottom of the main frame 36. A washer is used in the handlebar axis 61 base to facilitate the rotation. Subsequently a screw and a washer are used at the top to restrict axial movement of the handlebar axis 61.

Figure 24:
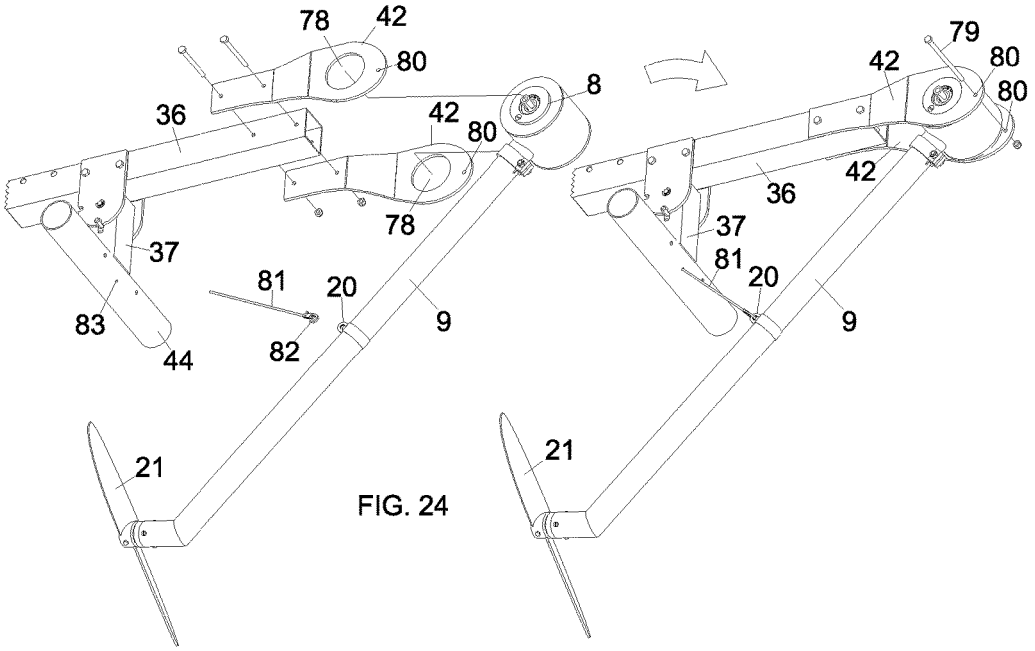
FIG. 24 is made up of figures that illustrate the process of assembling the rigid transmission system in a main frame of a compact boat with recumbent configuration according to the invention "compact, pedal-propelled boats"

To mount the rigid transmission system 9 in the main frame 36, as shown in FIG. 24, first each mounting plate 42 is positioned so that its circular hole 78 fits into the shoulder 8 present in right bushing 5 and left 7. Subsequently, the two mounting plates 42 are positioned so that their holes coincide with the holes on the front end of the main frame 36 allowing the passage of two bolts which secure the assembly after tightening the two nuts. After mounting the rigid transmission system 9 on the main frame 36, cranks can be installed. At this time the rigid transmission system 9 is mounted on the main frame 36 having all its movements restricted, except for rotational movement about the imaginary line joining the center of the two circular holes 78. According to FIG. 24, a bolt 79 is inserted through the hole 80 present on the mounting plate 42 on the right side, passing through the hole 80 present on the mounting plate 42 of the left side, and subsequently tightened by a nut. Tightening this nut regulates the torque required to articulate the rigid transmission system 9. To keep the rigid transmission system 9 in the correct position during operation, a flexible cable 81 having a hook 82 at one end is fixed in the hole 83 present in the T structure 37 as shown in FIG. 24. The fixing occurs through a simple knot in the end of the flexible cable 81 which is trapped inside the plug tube 44 due to the fact that the size of the knot is greater than the dimension of hole 83. The hook 82 is fitted in this hole in the support 20. In normal operation, the propeller 21 generates a force Fh that tends to rotate the rigid transmission system 9. The flexible cable 81 prevents rotation of the rigid transmission system 9 keeping it in the correct operating position. By reversing the direction of rotation of propeller 21, pedaling in reverse, the Fh force also changes its direction. In this situation, what prevents rotation it's the friction between right bushing 5 and left 7 and the mounting plates 42 which is adjustable by tightening bolt 79.

Figure 25:
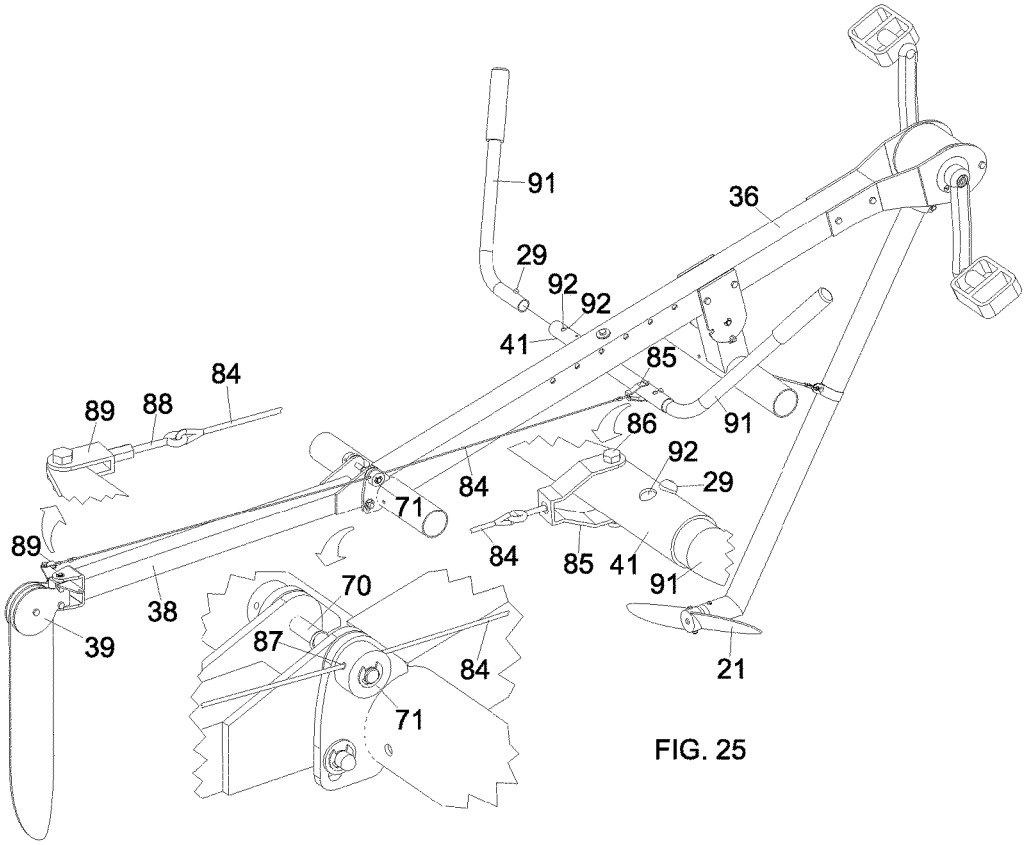
FIG. 25 is made up of figures that illustrate the assembly process of the flexible cable in the structure of a compact boat with recumbent configuration according to the invention "compact, pedal-propelled boats"

To allow maneuvering the boat, two flexible cables 84 are installed. FIG. 25 shows installation details of one of the flexible cables 84. For installation, one end of the flexible cable 84 is tied in the eye of the joint 85. The joint 85 is then positioned on the handlebar support 41 so that its holes coincide with the holes located on the right side of the handlebar support 41, and subsequently fixed by a bolt 86 and nut, getting free to rotate around the bolt 86. The other end passes through the hole 87 present in the cylinder guide 71 at the right side and then is tied in the eye of turnbuckle screw 88 in a position suitable to hold the flexible cable 84 stretched. The turnbuckle support 89 is fixed at the end of the left lever of the rudder assembly 39 by bolt and nut being free to rotate around this bolt. Subsequently, the turnbuckle screw 88 is screwed into the threaded hole present on turnbuckle support 89 to provide an adequate tension. The same process is repeated for the other side. As the flexible cables 84 pass through cylinder guide 71 which are located on the pivot pin 70 when the pivotable rudder tube 38 rotates about the pivot pin 70, flexible cables 84 remains tensioned. For operation, handlebars 91 are installed at each end of the handlebar support 41, as shown in FIG. 25. For installation, the locking pin 29 present on the handlebar 91 is pressed with the thumb, while the end of the handlebar 91 is inserted into the end of the handlebar support 41. There are two holes 92 present on the handlebar support 41 allowing two positions for engagement of the locking pin 29 and consequently two positions to the handlebar 91. The user chooses what is most appropriate for their height. The screw 86 also serves as a stop for the end of the handlebar 91, which facilitates installation.

Figure 26:
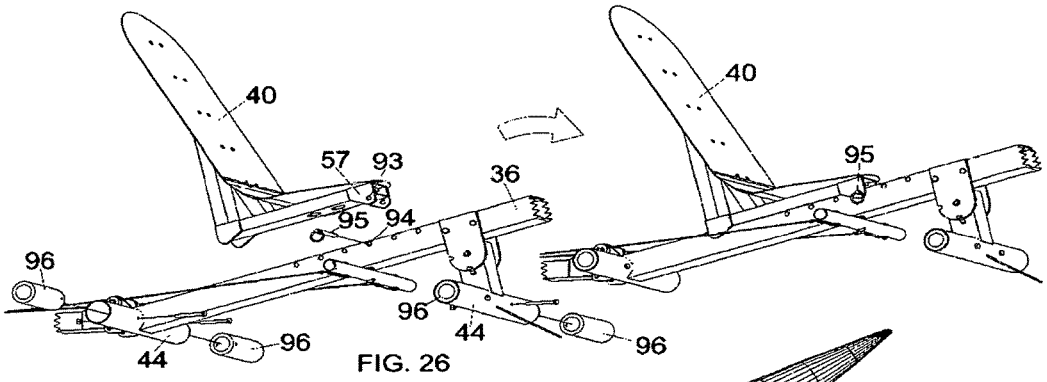
FIG. 26 is made up of figures that illustrate the assembly process of bushings and seat installation in the structure of a compact boat with recumbent configuration according to the invention "compact, pedal-propelled boats"

For operation, the seat 40 is installed on the main frame 36, as shown in FIG. 26. For installation, the seat 40 is positioned so that the holes 93 present in the fitting plates 57 is aligned with one of the holes 94 in the main frame 36. The user chooses what is most appropriate for their height. After alignment of the holes 93 and 94, a pin 95 can be introduced, completing the installation.

According to FIG. 26, four bushings 96 are installed at the ends of the plug tubes 44 and fixed by bolts and nuts. These bushings 96 allow fast fitting of the connecting bars 97, which connect the structure to the inflatable hulls 98, as can be seen in FIG. 27.

Figure 27:
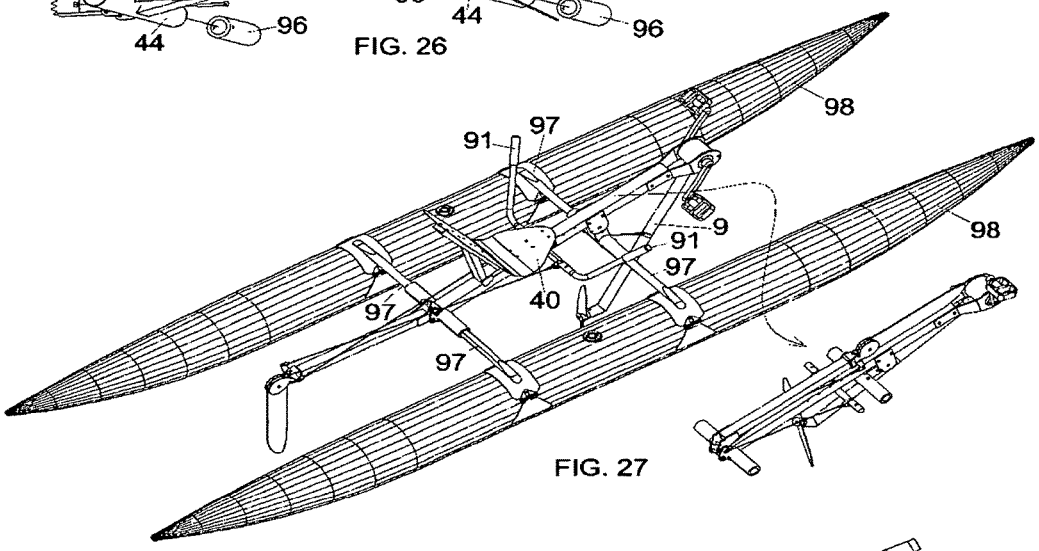
FIG. 27 is a perspective view of a compact boat with recumbent configuration, in the operation form ready to use according to the invention "compact, pedal-propelled boats", beside is the structure in the compact form ready for transport or storage.
Figure 28:
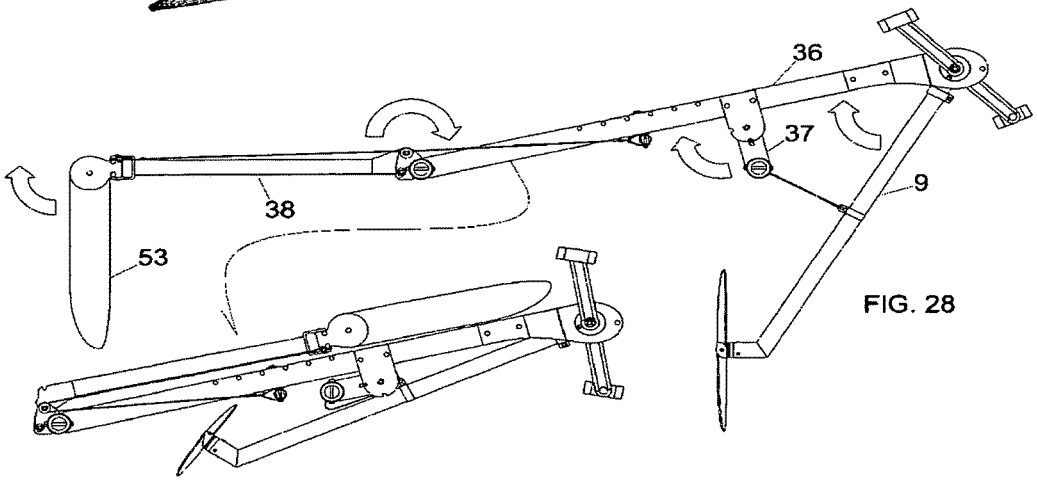
FIG. 28 is made up of figures that illustrate the folding process of the structure of a compact boat with recumbent configuration according to the invention "compact, pedal-propelled boats"

FIG. 27 shows the boat with recumbent configuration, assembled with the rigid transmission system 9 in the form of operation, ready for use. It takes a compact shape for storage or transport situations, as can also be seen in FIG. 27. To disassemble the boat, first inflatable hulls 98 are emptied and the four connecting bars 97 are removed. In sequence the seat 40 and handlebars 91 may be removed. All of these items already removed can be packed in a backpack. The structure can be folded as shown in FIG. 28, assuming the compact form. The backpack can be loaded in the back while the compact structure can be carried in the hand. The compact structure and backpack fit together in the trunk of most passenger cars.

Figure 29:
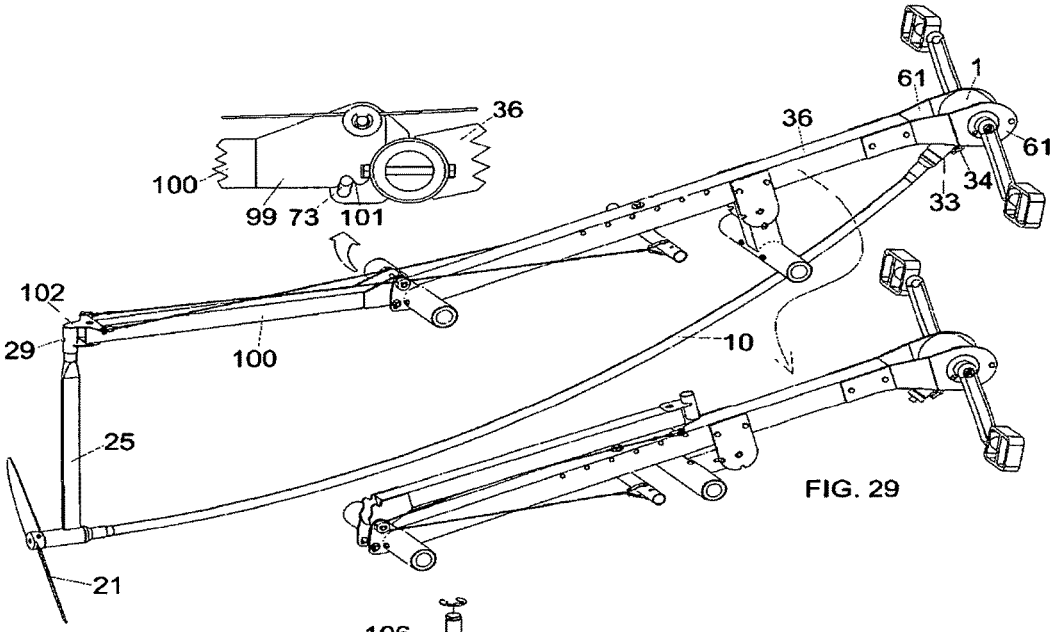
FIG. 29 is a perspective view of the structure of a compact boat with recumbent configuration mounted with flexible transmission system according to the invention "compact, pedal-propelled boats", beside is the structure in compact form.

FIG. 29 shows a structure for compact boat with recumbent configuration, assembled with a flexible transmission system 10. In FIG. 29 it can be seen the structure in the compact form. This structure shares many of the elements of the other structure, assembled with rigid transmission system 9, so that only the differences will be presented.

Figure 30:
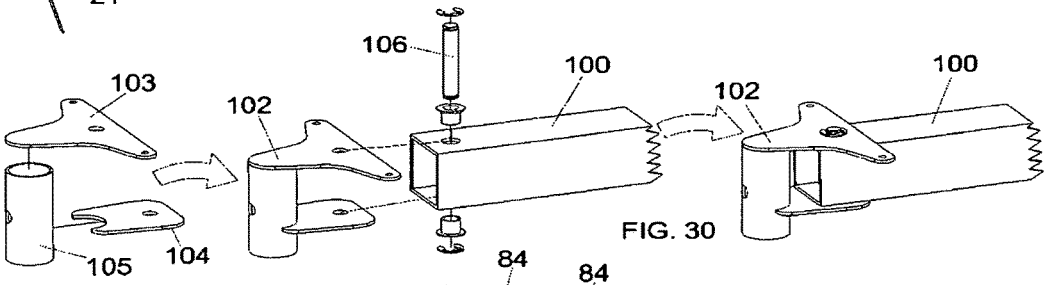
FIG. 30 is made up of figures that illustrate the manufacturing process of the hinge bracket and it's mounting in a square tube of a compact boat according to the invention "compact, pedal-propelled boats"

As can be seen in the enlarged detail of FIG. 29, the inner hinge plates 99 welded to the square tube 100 has a slight modification in the drawing for the slot 101 to allow disengagement of the cylindrical latch 73 in case of impact of propeller 21 or propeller mount 25 with the ground, preserving the components. According to FIG. 30, a hinge bracket 102 is assembled on the rear end of the square tube 100. The hinge bracket 102 is manufactured from the welding joining of the lever plate 103, the lower plate 104 and tube 105. To assemble the hinge bracket 102, first bushings are installed in the holes on the square tube 100, after the hinge bracket 102 is positioned so that the holes are aligned, allowing the introduction of a pin 106, which receives retaining rings at the ends for fixing it.

To allow maneuvering the vessel, two flexible cables 84 are installed in the same way as explained for the previous case. The gearbox 1 is installed on the main frame 36 in the same manner as the installation is made for the rigid transmission system 9, as already explained.

Figure 31:
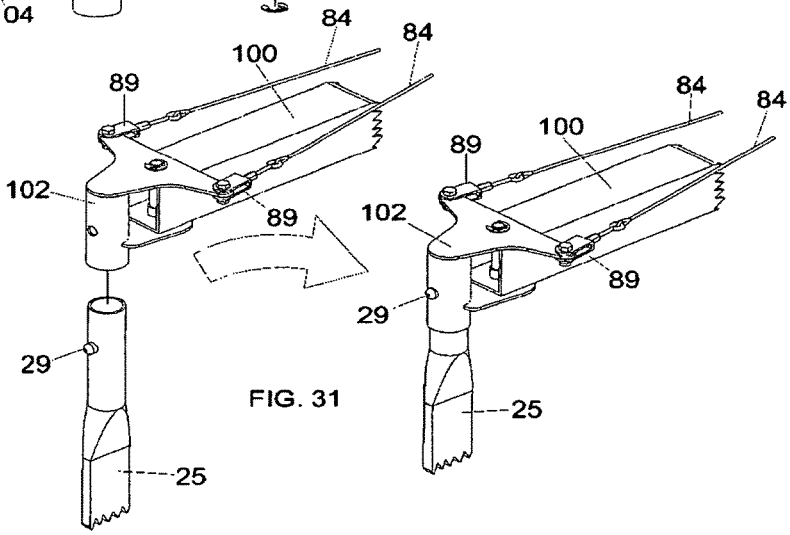
FIG. 31 is made up of figures that illustrate the propeller mount fitting process in the hinge bracket of a compact boat according to the invention "compact powered boats pedal"

For the installation of the flexible transmission system 10, simply press with the thumb the locking pin 29 and insert the end of the propeller mount 25 in the tube of hinge bracket 102 until the locking pin 29 engages in the hole in the wall of tube of hinge bracket 102 according to FIG. 31. Then the coupling 33 is embedded in the cylindrical housing 3 being fixed by the knob 34.

The remaining elements are mounted as in the previous case, as explained before.

Figure 32:
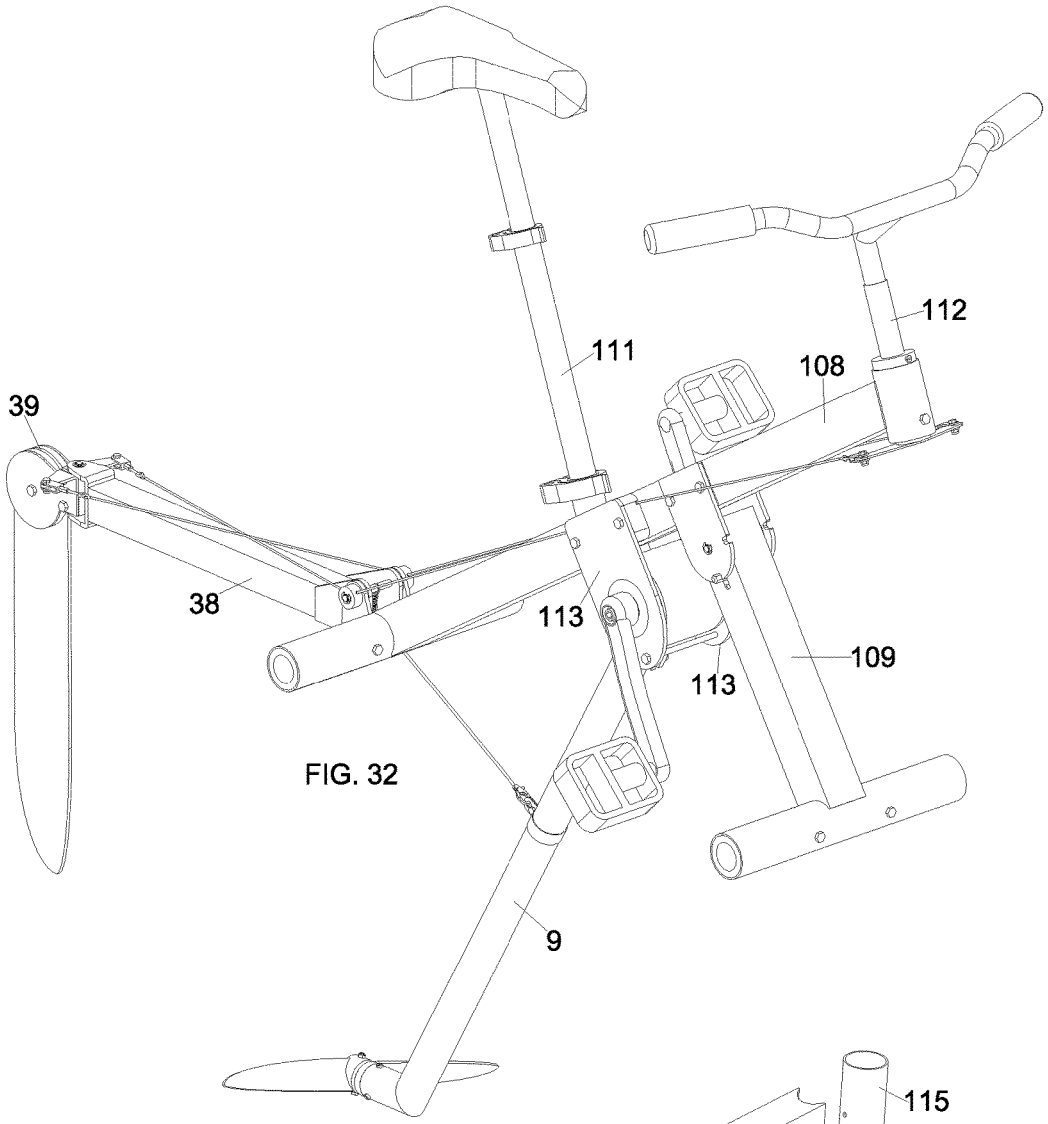
FIG. 32 is a perspective view of the frame for compact boat with conventional configuration according to the invention "compact, pedal-propelled boats", mounted with rigid transmission system.
Figure 33:
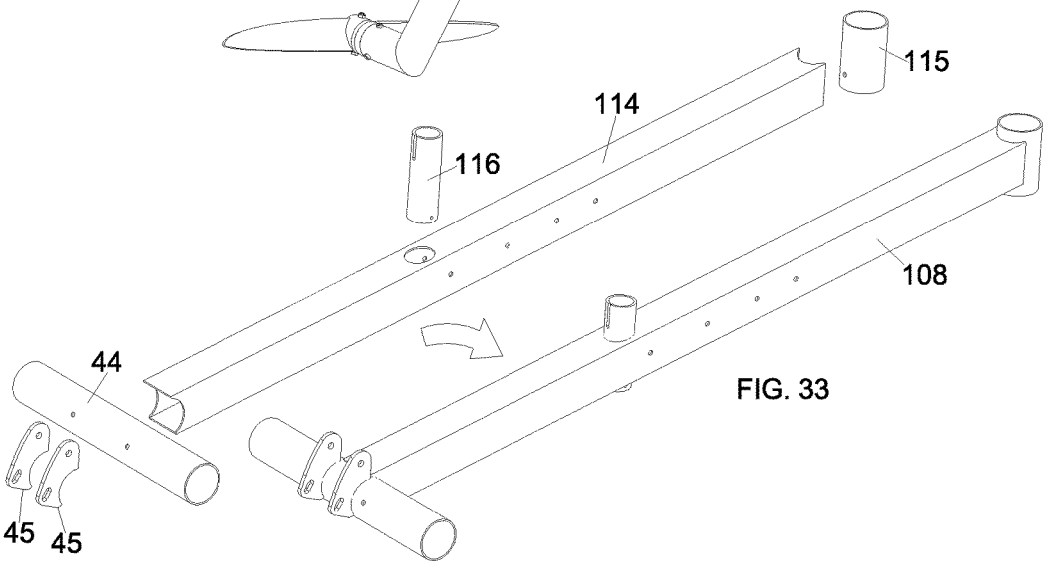
FIG. 33 is made up of figures that illustrate the manufacturing process of a main frame of a compact boat with conventional configuration according to the invention "compact, pedal-propelled boats"
Figure 34:
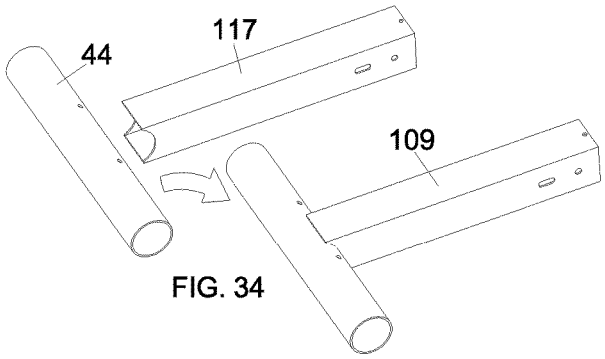
FIG. 34 is made up of figures that illustrate the manufacturing process of a T structure of a compact boat with a conventional configuration according to the invention "compact, pedal-propelled boats"
Figure 35:
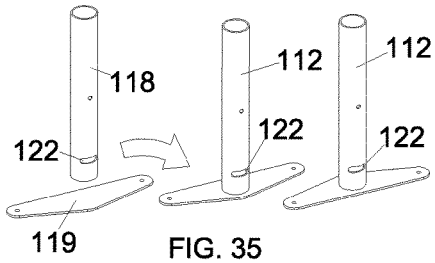
FIG. 35 is made up of figures that illustrate the manufacturing process of a handlebar mount of a compact boat with conventional configuration according to the invention "compact, pedal-propelled boats"
Figure 36:
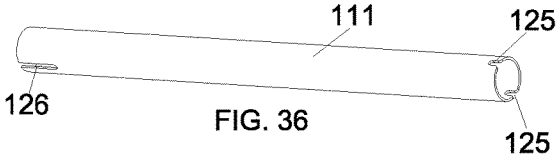
FIG. 36 is a perspective view of a seat tube for a compact boat with conventional configuration according to the invention "compact, pedal-propelled boats"

FIG. 32 shows a structure for a compact boat with conventional configuration, assembled with a rigid transmission system 9. The main component parts of said structure are: main frame 108, T structure 109, pivotable rudder tube 38, rudder assembly 39, seat tube 111, handlebar mount 112 and mounting plates 113. This structure uses some elements already explained above. According to FIG. 33, main frame 108 is formed by the long square tube 114, plug tube 44 handlebar housing 115, the seat base 116 and two outer hinge plates 45, which are joined by welding. According to FIG. 34, the T structure 109 is formed by a short square tube 117 and a plug tube 44, which are joined by welding. According to FIG. 35, the handlebar mount 112 is formed by the mount tube 118 and the lever 119, which are joined by welding. FIG. 36 shows the seat tube 111, where can be seen the detail of the slots 125 and 126. According to FIG. 37, the T structure 109 is mounted to the main frame 108 through the use of two hinge plates 62, in the same way as explained for the case of recumbent configuration, allowing the T structure 109 to be locked in two positions, operating position extended and the retracted position. The only difference is that in the conventional configuration the T structure 109 retracts forward while in recumbent it retracts backwards.

Figure 37:
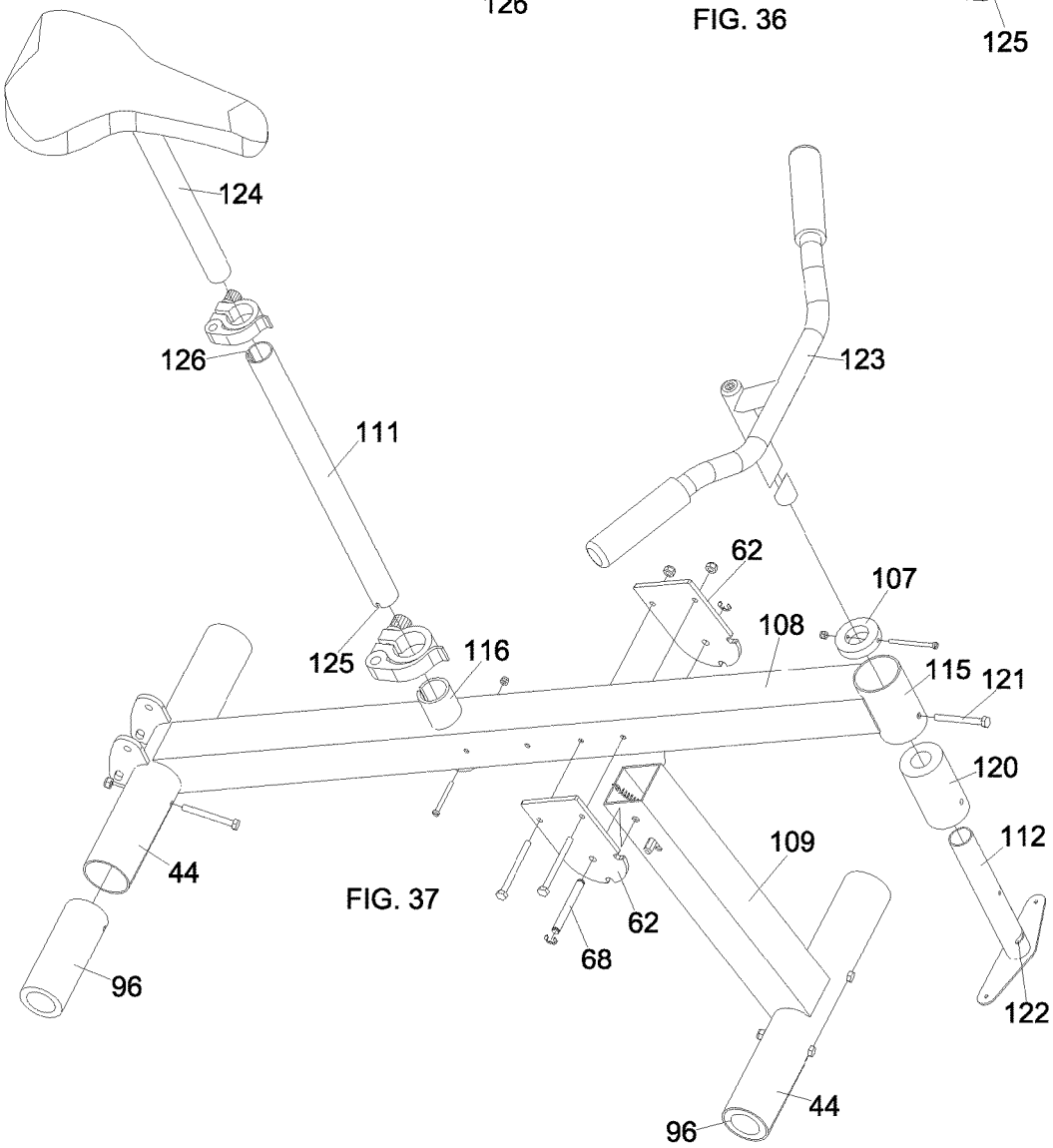
FIG. 37 is an exploded perspective view showing the assembly of the various components in a main frame of a compact boat with conventional configuration according to the invention "compact, pedal-propelled boats"

According to FIG. 37, for mounting the handlebar mount 112, first a bushing 120 is inserted into the handlebar housing 115. Subsequently the handlebar mount 112 is introduced from the bottom. A bolt 121 is then screwed onto the front of the handlebar housing 115 through the bushing 120 and through the radial slot 122 located in the support tube 118. This bolt 121 restricts rotation of the mount tube 118, functioning as a stopper. At the top of the handlebar mount 112, a washer 107 is mounted to support the axial force on the handlebar mount 112 being secured with a bolt and nut. For use, a handlebar 123 of the type used in bicycles, is installed at the end of the mount tube 118 and can be removed for transport and storage situations.

According to FIG. 37, a seat with seat post 124 of the type used in bicycles is assembled on the upper end of the seat tube 111, and fixed with the aid of a clamp. The resulting assembly, seat with seat post 124 and the seat tube 111 is installed on the seat base 116 and secured with the aid of a clamp. This assembly can be removed for transport and storage situations. A nut and bolt are permanently fixed at the lower end of the seat base 116, which serves as stop and guide for the installation since it fit in the two slots 125 in the lower end of the seat tube 111 which have an angle of 90 degrees with the slot 126 present at the other end. According to FIG. 37, four bushings 96 are installed at the ends of the plug tubes 44 and fixed by bolts and nuts. These bushings 96 allow quick fitting of the connecting bars 97, which connects the structure to the inflatable hulls 98.

Figure 38:
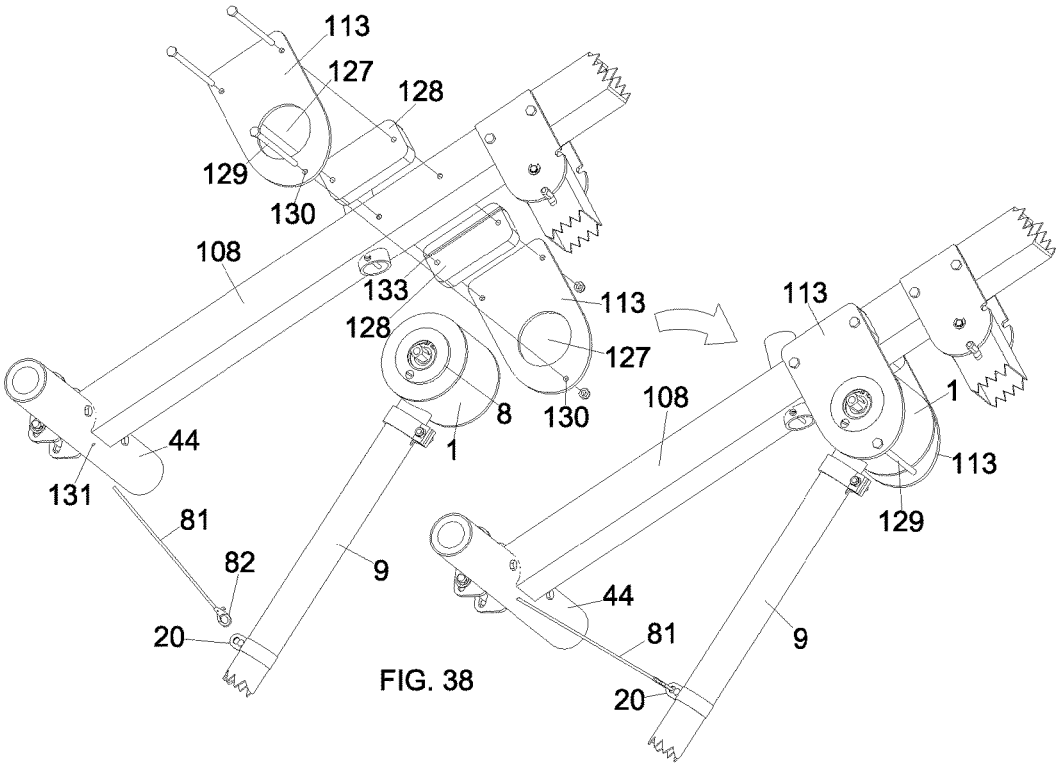
FIG. 38 is made up of figures that illustrate the process of assembling the rigid transmission system in the main frame of a compact boat with conventional configuration according to the invention "compact, pedal-propelled boats"

According to FIG. 38, for fixing the rigid transmission system 9 on the main frame 108, first each mounting plates 113 is positioned so that its circular hole 127 engages the shoulder 8 present the right bushing 5 and left 7. Subsequently, the two mounting plates 113 are positioned on two spacer blocks 128 that are positioned on either side of the central region of the main frame 108, so that all the holes are aligned allowing the passage of two through bolts which secure the assembly after tightening with two nuts. After mounting the rigid transmission system 9 on the main frame 108 cranks can be installed. At this time the rigid transmission system 9 is mounted on the main frame 108 having all its movements restricted, except for rotational movement about the imaginary line joining the center of the two circular holes 127. A bolt 129 is inserted through the hole 130 present in the mounting plates 113 to the right, passing through the hole 130 present in the mounting plates 113 of the left side, and subsequently tightened by a nut. Tightening this nut regulates the torque required to articulate the rigid transmission system 9. To keep the rigid transmission system 9 in the correct position during operation, a flexible cable 81 having a hook 82 at one end is fixed in the hole 131 present in the central position of the plug tube 44 of the main frame 108, as shown in FIG. 38. The fixing is through a simple knot at the end of the flexible cable 81, which is trapped inside the plug tube 44 due to the fact dimension the knot is greater than the dimension of the hole 131. The hook 82 is fitted in this hole in the support 20. In normal operation, the propeller 21 generates a force Fh which tends to rotate the rigid transmission system 9. The flexible cable 81 prevents rotation of the rigid transmission system 9 keeping it in the correct operating position. By reversing the rotation direction of propeller 21, pedaling in reverse, the Fh force also changes its direction. In this situation what prevents rotation is the friction between right bushing 5 and left 7 and the mounting plates 113 which is regulated by the tightening of bolt 129.

The pivotable rudder tube 38 is pivotally mounted on the two outer hinge plates 45 in the rear of the main frame 108 in the same way as explained for the recumbent configuration. The locking mechanism in the operational position extended is also the same. The rudder assembly 39 is mounted on the rudder mount 49 as explained before.

Figure 39:
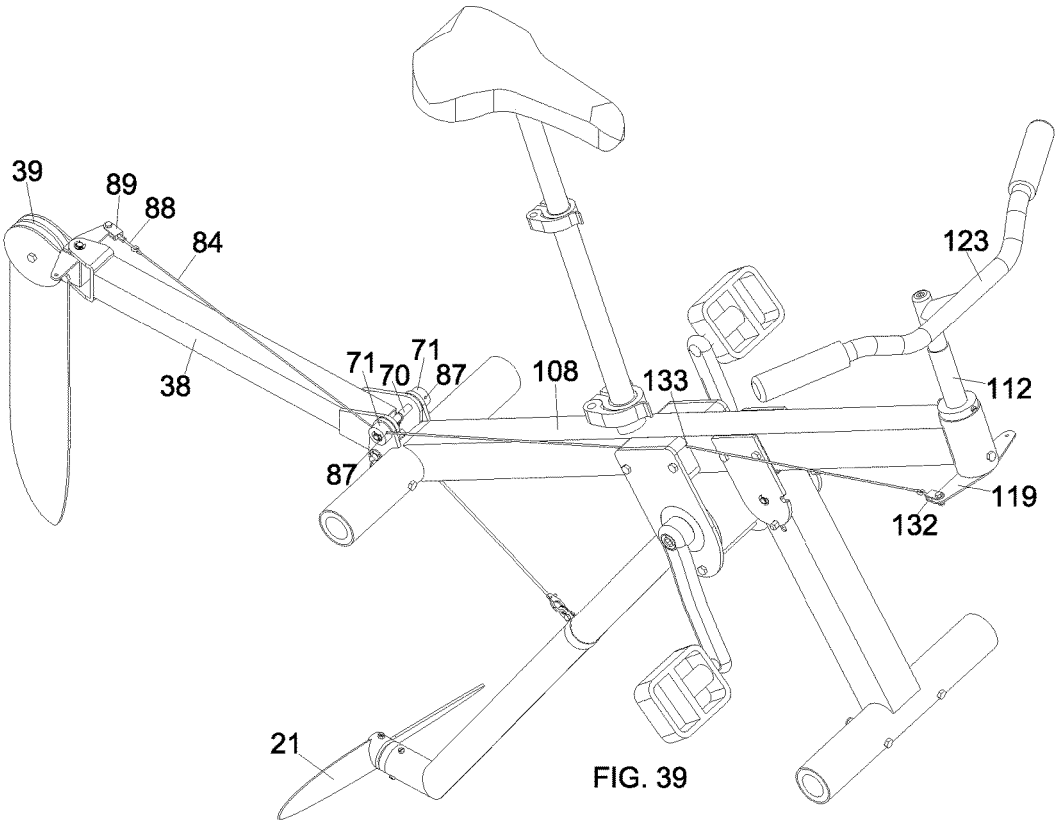
FIG. 39 is a perspective view illustrating the assembly process of the flexible cable in a structure of a compact boat with conventional configuration according to the invention "compact, pedal-propelled boats"

To allow maneuvering the boat, two flexible cables 84 are installed. FIG. 39 shows one of the flexible cables 84 installed in the structure. For installation, one end of the flexible cable 84 is tied in the eye of the joint 132. The joint 132 is then positioned on the lever 119 so that its holes coincide with the hole located on the right of lever 119 and is subsequently fixed by a bolt and nut being free to rotate around the bolt. The other end passes through the channel 133 of the spacer block 128 located on the right side and then through the hole 87 present in the cylinder guide 71 at the right side and then is tied in the eye of turnbuckle screw 88 in a position suitable to hold the flexible cable 84 stretched. The turnbuckle support 89 is fixed at the end of the left lever of the rudder assembly 39 by bolt and nut being free to rotate around this bolt. Subsequently the turnbuckle screw 88 is screwed into the threaded hole present on turnbuckle support 89 to provide an adequate tension. The same process is repeated for the other side. As the flexible cables 84 pass through cylinder guide 71 that is located on the pivot pin 70, when the pivotable rudder tube 38 rotates relative to the pivot pin 70, the flexible cables 84 remains tensioned.

Figure 40:
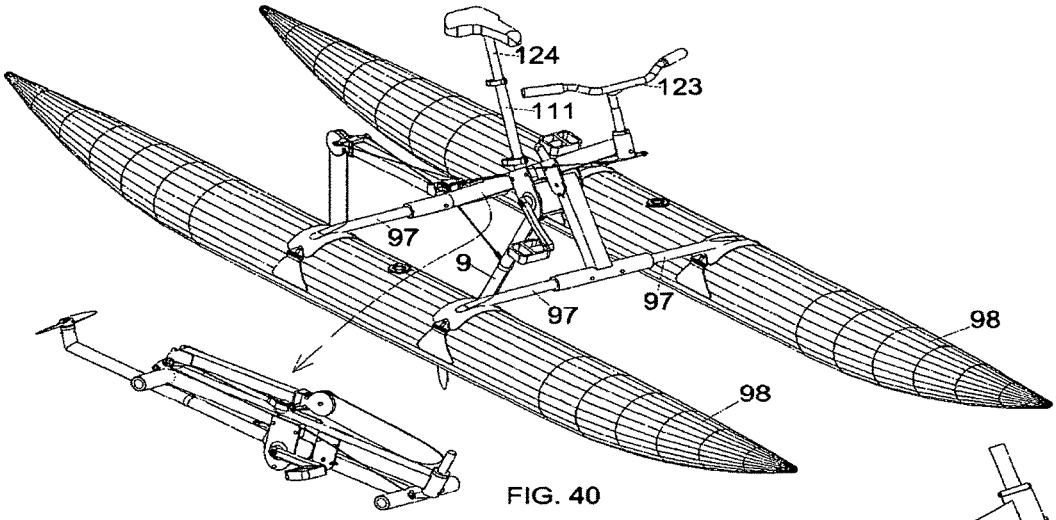
FIG. 40 is a perspective view of a compact boat with a conventional configuration, in the operation form ready to use according to the invention "compact, pedal-propelled boats", beside is the structure in the compact form ready for transport or storage.
Figure 41:
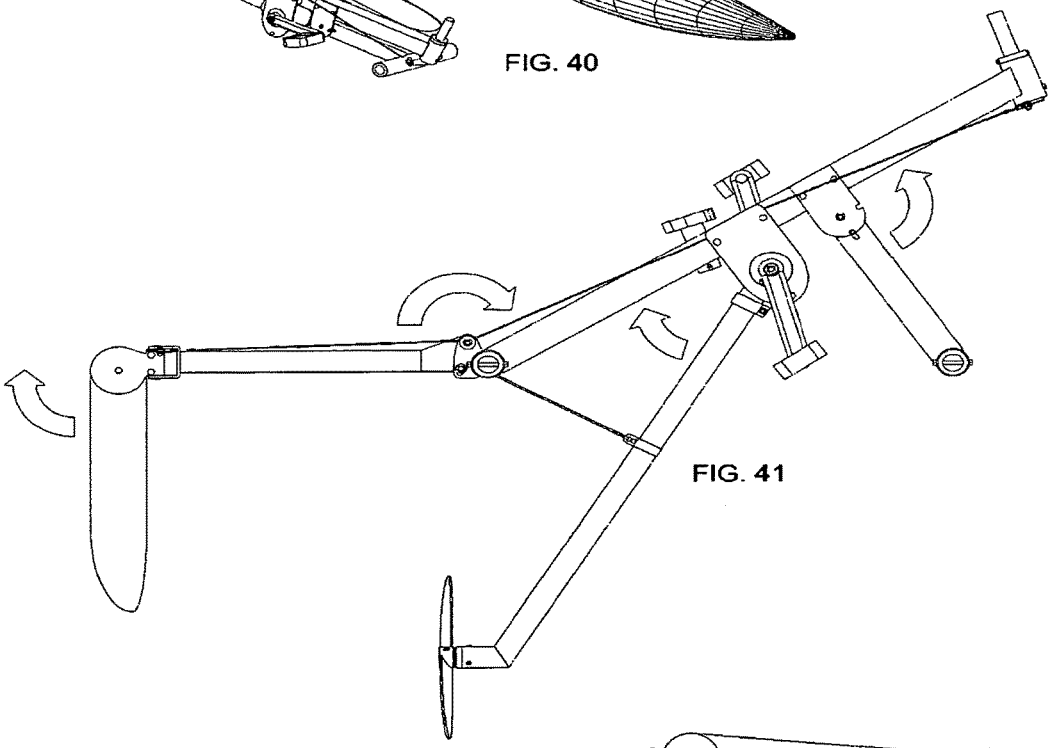
FIG. 41 is made up of figures that illustrate the folding process of the structure of a compact boat with conventional configuration according to the invention "compact, pedal-propelled boats"
Figure 42:
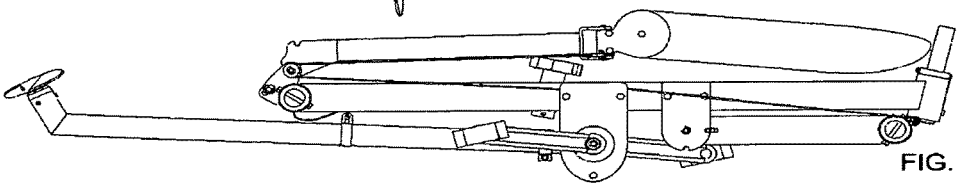
FIG. 42 is a side view of the structure of a compact boat with conventional configuration according to the invention "compact, pedal-propelled boats", in the compact form ready for transport or storage.

FIG. 40 shows the boat with a conventional configuration, assembled with the rigid transmission system 9 in the form of operation, ready for use. It takes a compact shape for storage or transport situations, as can also be seen in FIG. 40. To disassemble the boat, first inflatable hulls 98 are emptied and the four connecting bars 97 are removed. In sequence the seat with seat post 124 and the seat tube 111 is removed, as well as the handlebar 123. All of those items already removed can be packed in a backpack. The structure can be folded as shown in FIG. 41, assuming the compact form, as shown in FIG. 42. The backpack can be loaded in the back while the compact structure can be carried in the hand. The compact structure and backpack fit together in the trunk of most passenger cars.

Figures 43, 44:
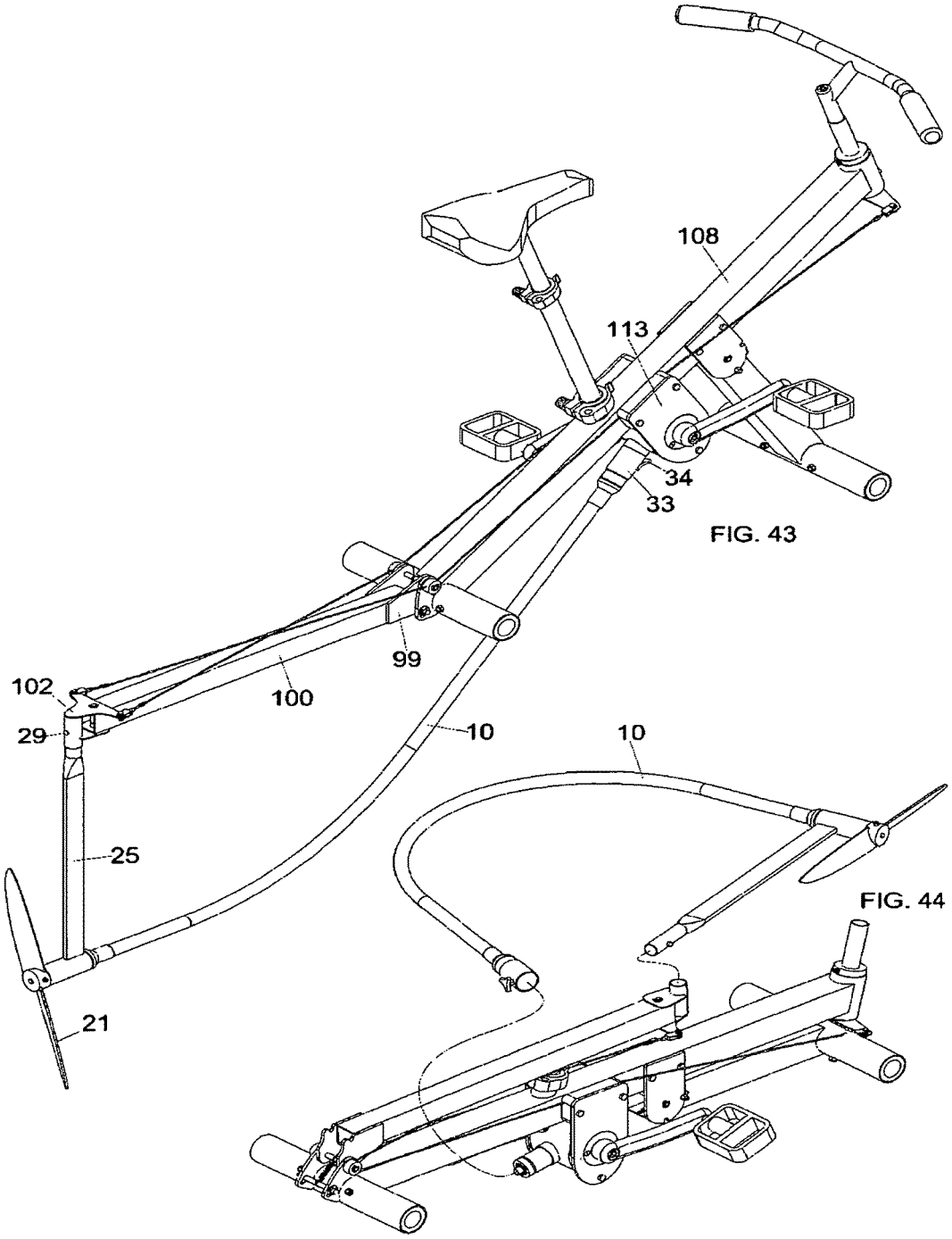
FIG. 43 is a perspective view of the structure of a compact boat with conventional configuration mounted with a flexible transmission system according to the invention "compact, pedal-propelled boats"
FIG. 44 is made up of figures that illustrate the structure of a compact boat with conventional configuration in the compact form ready for transport or storage next to the flexible transmission system according to the invention "compact, pedal-propelled boats"

FIG. 43 shows a structure for a boat with a conventional configuration for use with flexible transmission system 10. This structure shares many of the elements of the other structure, assembled with rigid transmission system 9, so that only the differences will be discussed.

The inner hinge plates 99 welded to the square tube 100 has a slight modification in the drawing for the slot 101 to allow disengagement of the cylindrical latch 73 in case of impact of propeller 21 or propeller mount 25 with the ground. This modification is the same already addressed to the recumbent configuration.

A hinge bracket 102 is assembled on the rear end of the square tube 100 as already explained.

To allow maneuvering the boat, two flexible cable 84 are installed in the same way as explained for the previous case. The gearbox 1 is installed on the main frame 108 in the same manner as the installation is made for the rigid transmission system 9, as already explained.

For the installation of the flexible transmission system 10, simply press with the thumb the locking pin 29 and insert the end of the propeller mount 25 in the tube of hinge bracket 102 until the locking pin 29 engages in the hole in the wall of tube of hinge bracket 102. Then the coupling 33 is embedded in the cylindrical housing 3 being fixed by the knob 34.

The rest of the elements are assembled as in the previous case, as already explained.

FIG. 44 shows the structure for a compact boat with a conventional configuration for use with flexible transmission system 10 in compact form for storage or transport situations. The flexible transmission system 10 removed is shown alongside.

Figure 45:
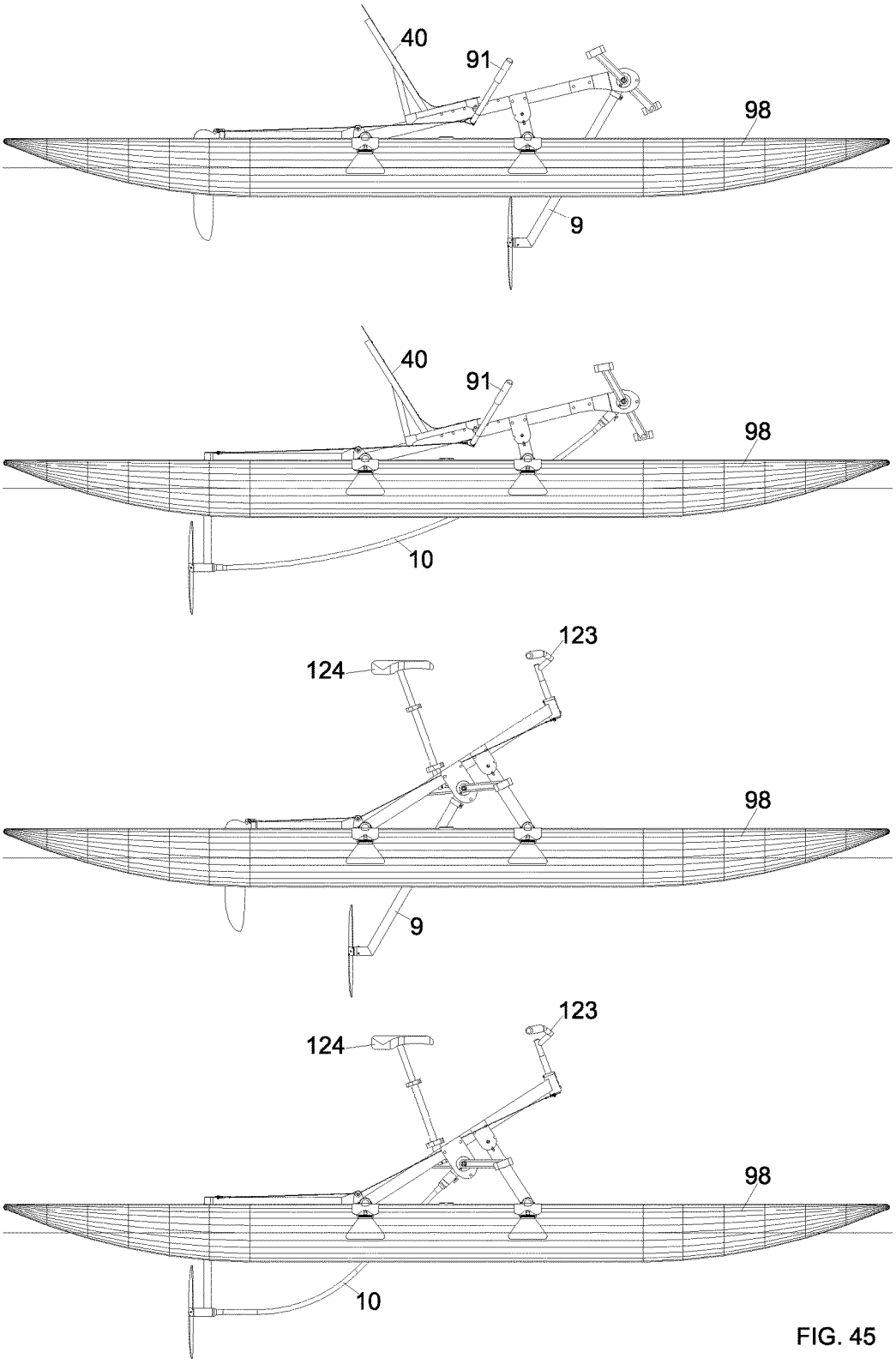
FIG. 45 is made up of figures that illustrate the side view of all configurations of boats according to the invention "compact, pedal-propelled boats", in operating condition ready to use.

FIG. 45 shows all the configurations covered by the present invention, is in the form of operation, ready for use.

The invention claimed is:

1. A compact, pedal-propelled boat comprising:

a gearbox (1) made from a tube (2) and a cylindrical housing (3) allowing a pinion having a shaft (4) being supported by two bearings housed inside the cylindrical housing (3) and a gear having a shaft (6) being supported by one of the two bearings housed in a right bushing (5) and the other of the two bearings housed in a left bushing (7) allowing that two retaining rings (27) installed on the gear shaft (6), one on a right and other on a left side, restrict relative axial movement between the gear shaft (6) and the gearbox (1) so that the gear remains engaged to the pinion; and the right bushing (5) and the left bushing (7) each have a shoulder on an outside thereof;

an outer tube (11) being made from two tubes, a long tube (12) and a short tube (13) which are joined at an angle around 120 degrees allowing an assembly to be inserted inside, wherein the assembly comprises a torque tube (14) having a first end fixed to an end of the pinion shaft (4) and a second end fixed to an intermediate shaft (15) and the intermediate shaft (15) is supported by a bearing housed within an intermediate bushing (16);

the intermediate shaft (15) is fixed to a double universal joint (17);

a second end of the double universal joint (17) is fixed to a propeller shaft (18);

wherein the assembly can be inserted into the outer tube (11) until the moment when an end of the outer tube (11) is fitted on the outside of the cylindrical housing (3) of the gearbox (1) and the propeller shaft (18) is positioned inside the short tube (13) allowing a propeller bushing (19) to be inserted inside the short tube (13);

the propeller shaft (18) is supported by two bearings housed in the propeller bushing (19) allowing an elastic ring to be installed on the propeller shaft (18), which together with the end of the double universal joint (17) restrict axial movement of the propeller shaft (18) relative to the propeller bushing (19) and the propeller bushing (19) can be fixed in the short tube (13), transferring to the short tube (13) stress caused by a propeller (21) installed on the propeller shaft (18);

cranks and pedals are installed at ends of the gear shaft (6) which, when operating the pedals, the gear shaft (6) drives the pinion shaft (4) which, in turn, transmits the movement through the torque tube (14) to the double universal joint (17), which allows for a homokinetic transmission of movement to the propeller shaft (18).

2. A compact, pedal-propelled boat comprising:

a propeller mount (25) comprising a rod (26) having a locking pin (29) at one end and joined perpendicular to a propeller bushing (28) at the other end where a propeller shaft (31) is supported by two bearings housed in the propeller bushing (28) so that axial movement of the propeller shaft (31) relative to the propeller bushing (28) is restricted by retaining rings transferring to the propeller bushing (28) stress caused by a propeller (21) installed in the propeller shaft (31);

the propeller bushing (28) has an internal thread at one end for fixing a threaded terminal (24) which is screwed onto the end of the propeller bushing (28) and the threaded terminal (24) is fixed to a first end of a flexible tube (23) and a flexible shaft (22) is positioned inside the flexible tube (23) and a first end of the propeller shaft (31) has a snap mechanism which engages a first end of the flexible shaft (22) allowing transmission of rotational movement, and a second end of the flexible tube (23) is fixed to a coupling (33) via a threaded terminal (24);

the coupling (33) fits on an outside of a cylindrical housing (3) and a first end of a pinion shaft (4) has a snap mechanism which engages to a second end of the flexible shaft (22) allowing transmission of rotational movement, and cranks and pedals are installed at ends of a gear shaft (6) which when operating the pedals, the gear shaft (6) rotates driving the pinion shaft (4) which in turn transmits motion to the flexible shaft (22) which in turn transmits movement to the propeller shaft (31).

3. A compact, pedal-propelled boat comprising:

a main frame (36); a T structure (37); a pivotable rudder tube (38); a rudder assembly (39); a seat (40); a handlebar support (41); two mounting plates (42); and a a transmission system wherein the main frame (36) is formed by a long square tube (43), a plug tube (44) and two outer hinge plates (45); and the T structure (37) is formed by a short square tube (46) and a plug tube (44); and the pivotable rudder tube (38) is formed by a square tube (47), two inner hinge plates (48) and a rudder mount (49); and the seat (40) is formed by a base tube (54), a backrest tube (55), a brace tube (56), two fitting plates (57), two alignment plates (58) and a seat plate (59); and the handlebar support (41) is formed by a support tube (60) and a handlebar axis (61); and the T structure (37) is mounted on the main frame (36) through the use of two hinge plates (62) that are fixed to the main frame (36) and a pivot pin (68) allows the T structure (37) to rotate about the pivot pin (68); and the pivotable rudder tube (38) is pivotally mounted on the outer hinge plates (45) in the rear of the main frame (36) using a pivot pin (70); and two cylinder guide (71) are mounted on each end of the pivot pin (70); and the rudder assembly (39) is mounted on the rudder mount (49) and can pivot about a pivot pin (77) used in fixing; and the handlebar support (41) is mounted in central position of the main frame (36) so as to pivot about the handlebar axis (61); and first and second flexible cables (84) are installed so that an end of the first flexible cable (84) is fixed in a joint (85) which is fixed in articulated manner on a right side of the handlebar support (41) and the other end of the first flexible cable (84) passes through a hole (87) present in the cylinder guide (71) on a right side and is then fixed to a turnbuckle support (89) which is mounted in an articulated manner on a left lever of the rudder assembly (39) and an end of the second flexible cable (84) is fixed in a joint (85) which is fixed in articulated manner on a left side of the handlebar support (41) and the other end of the second flexible cable (84) passes through a hole (87) present in the cylinder guide (71) on a left side and is then fixed to then turnbuckle support (89) which is mounted in an articulated manner on a right lever of the rudder assembly (39); and the first and second flexible cables (84) are mounted in tensioned manner, allowing the handlebar support (41) to be mechanically connected to the rudder assembly (39); and two handlebars (91) are installed, one on each end of the support tube (60); and the seat (40) is installed on the main frame (36) by inserting a pin (95) passing through holes (93) present on the fitting plates (57) and one of holes (94) in the main frame (36); four bushings (96) are mounted on the ends of plug tubes (44); and wherein the transmission system is either a rigid transmission system (9) mounted in an articulated manner between two mounting plates (42) fixed on the front of the main frame (36) each having circular holes, the rigid transmission system being positioned so that the circular holes (78) engage shoulders (8) present on a right bushing (5) and a left bushing (7) of the rigid transmission system; a bolt (79) is mounted though holes (80) present on the mounting plates (42); and a flexible cable (81) containing a hook (82) at one end is fixed in a hole (83) present in the T structure (37) and the hook (82) is embedded in a hole in a support (20) mounted on an outside of an outer tube (11); or a flexible transmission system (10) and a hinge bracket (102) which is pivotally mounted on a rear end of a square tube (100) around a pin (106); the hinge bracket (102) is formed by a lever plate (103), a lower plate (104) and a tube (105); the ends of flexible cables (84) fixed on the turnbuckle support (89) are mounted in an articulated manner on the ends of the lever plate (103); and a gearbox (1) is mounted between two mounting plates (42) fixed on the front of the main frame (36) each having circular holes, the gearbox (1) being positioned so circular holes (78) engage shoulders (8) present on a right bushing (5) and a left bushing (7) of the gearbox; and the flexible transmission system (10) is installed so that a coupling (33) is embedded in a cylindrical housing (3) and an end of a rod (26) is fitted into the tube (105).

4. A compact, pedal-propelled boat comprising:

a main frame (108); a T structure (109); a pivotable rudder tube (38); a rudder assembly (39); a seat tube (111); a handlebar mount (112); two mounting plates (113) and a transmission system; wherein the main frame (108) is formed by a long square tube (114), a plug tube (44), a handlebar housing (115), a seat base (116) and two outer hinge plates (45); and the T structure (109) is formed by a short square tube (117) and a plug tube (44); and the handlebar mount (112) is formed by a mount tube (118) and a lever (119); and the T structure (109) is mounted to the main frame (108) through the use of two hinge plates (62) that are fixed to the main frame (108), and a pivot pin (68), allowing the T structure (109) to pivot about the pivot pin (68); and the seat tube (111) is installed in the seat base (116) and secured with clamps; and a seat with seat post (124) is installed in the seat tube (111), and fixed with clamp; the pivotable rudder tube (38) is pivotally mounted on the outer hinge plates (45) 14 at a rear of the main frame (108) using a pivot pin (70); and two cylinder guides (71) are mounted on each end of the pivot pin (70); and the rudder assembly (39) is mounted on a rudder mount (49) being able to pivot about a pivot pin (77) used in fixing; and a bushing (120) is inserted into the handlebar housing (115); and the handlebar mount (112) is inserted into the bushing (120); and a bolt (121) is screwed on front of the handlebar housing (115) through the bushing (120) and a radial slot (122) located in the mount tube (118); and a handlebar (123) is installed on the handlebar mount (112); and first and second flexible cables (84) are installed so that an end of the first flexible cable (84) is fixed in a joint (132) which is mounted pivotally on a right side of the lever (119), and the other end of the first flexible cable (84) passes through a channel (133) of the spacer block (128) located on a right side and then through a hole (87) present in the cylinder guide (71) on the right and is then fixed to a turnbuckle support (89) which is mounted in an articulated manner on a left lever of the rudder assembly (39) and an end of the second flexible cable (84) is fixed in a joint (132) which is mounted pivotally on a left side of the lever (119), and the other end of the second flexible cable (84) passes through a channel (133) of the spacer block (128) located on a left side and then through a hole (87) present in the cylinder guide (71) on the left and is then fixed to a turnbuckle support (89) which is mounted in an articulated manner on a right lever of the rudder assembly (39); and the first and second flexible cables (84) are mounted in a tensioned manner, allowing the handlebar mount (112) to be mechanically connected to the rudder assembly (39); and four bushings (96) are mounted in the ends of the plug tubes (44);

wherein the transmission system is either a rigid transmission system (9) mounted in an articulated manner between two mounting plates (113) fixed on two spacer blocks (128) that are positioned on either side of a central region of the main frame (108) and each mounting plate (113) having circular holes, the rigid transmission system being positioned so that the circular holes (127) engage shoulders (8) present on a right bushing (5) and a left bushing (7) of the rigid transmission system; a bolt (129) is mounted though holes (130) present on the mounting plates (113); and a flexible cable (81) containing a hook (82) at one end is fixed in a hole (131) present in the central position of the plug tube (44) of the main frame (108) and the hook (82) is embedded in a hole in a support (20) mounted on an outside of an outer tube (11); or a flexible transmission system (10) and a hinge bracket (102) which is pivotally mounted on a rear end of a square tube (100) around a pin (106); the hinge bracket (102) is formed by a lever plate (103), a lower plate (104) and a tube (105); the ends of flexible cables (84) fixed on the turnbuckle support (89) are mounted in an articulated manner on the ends of the lever plate (103); and a gearbox (1) is mounted between two mounting plates (113) fixed on two spacer blocks (128) that are positioned on either side of a central region of the main frame (108) and each mounting plate (113) having circular holes, the gearbox (1) being positioned so circular holes (127) engage shoulders (8) present on a right bushing (5) and a left bushing (7) of the gearbox (1); and the flexible transmission system (10) is installed so that a coupling (33) is embedded in a cylindrical housing (3) and an end of a rod (26) is fitted into the tube (105).

5. A compact, pedal-propelled boat according to claim 4 comprising:

a T structure (109) having a longitudinal slot (63) in which a lock (64) with two spacer cylinders (65) and a coupling plate (66) is mounted being positioned inside the T structure (109), so that holes overlap, allowing the introduction of the lock (64); and then a tension spring (67) is mounted, and one side fits through a hole in the coupling plate (66) and the other side to a hole at an end of the T structure (109) and as the coupling plate (66) is positioned in a center position, it fits into a groove present in a central position of the lock (64), restricting its axial movement; and the T structure (109) is positioned between hinge plates (62), so that holes overlap, allowing the introduction of a pivot pin (68); and the hinge plates (62) have two notches (69) for engaging the lock (64) allowing the T structure (109) being locked in two positions, an extended position and a retracted position.

6. A compact, pedal-propelled boat according to claim 4 comprising:

two outer hinge plates (45) having a slot (72) where a latch (73) is inserted; and two washers (74) are installed, one on each end of the latch (73) and two retaining rings are installed to restrict axial movement of the latch (73); and a tension spring (75) is mounted, with one side engaging in a groove present in a central portion of a pivot pin (70) and the other side in a groove in a central part of the latch (73); and inner hinge plates (48) have a notch (76) for engaging the latch (73), allowing a pivotable rudder tube (38) being locked in an extended position.

* * * * *